US012503812B2

(12) United States Patent
Forgacs

(10) Patent No.: US 12,503,812 B2
(45) Date of Patent: Dec. 23, 2025

(54) LAUNDRY SORTING AND PROCESSING SYSTEM AND METHOD

(71) Applicant: Sortana LLC, Newport, RI (US)

(72) Inventor: Joshua Forgacs, Newport, RI (US)

(73) Assignee: Sortana LLC, Newport, RI (US)

( * ) Notice: Subject to any disclaimer, the term of this patent is extended or adjusted under 35 U.S.C. 154(b) by 190 days.

(21) Appl. No.: 17/990,199

(22) Filed: Nov. 18, 2022

(65) Prior Publication Data

US 2023/0160137 A1 May 25, 2023

Related U.S. Application Data

(60) Provisional application No. 63/281,124, filed on Nov. 19, 2021.

(51) Int. Cl.
*D06F 95/00* (2006.01)

(52) U.S. Cl.
CPC ..... *D06F 95/004* (2013.01); *D06F 95/002* (2013.01)

(58) Field of Classification Search
CPC .... D06F 95/004; D06F 95/002; D06F 95/006; D06F 95/00
See application file for complete search history.

(56) References Cited

U.S. PATENT DOCUMENTS 1,458,440 A * 6/1923 Robison ..... D06F 95/002 217/7
1,572,971 A * 2/1926 Syers ..... D06F 95/004 211/12
2,625,973 A * 1/1953 Weldon ..... D06F 95/004 312/211
2,901,262 A * 8/1959 Berlin ..... B62B 3/027 280/47.35

(Continued)

FOREIGN PATENT DOCUMENTS

DE 198 17 658 A1 1/1999
DE 29824079 U1 * 6/2000 ..... B62B 3/106
JP 2000085908 A * 3/2000

OTHER PUBLICATIONS

Laundry Bag Buyer's Guide, LaundryBags.com, Aug. 2, 2021, laundrybags.com/laundrybags-com-blog/Laundry-Bag-Buyer-s-Guide.

(Continued)

*Primary Examiner* — William L Miller
(74) *Attorney, Agent, or Firm* — Robert Joseph Hess; Hess Patent Law Firm

(57) ABSTRACT

A laundry sorting and processing system may include a main support frame. Soiled laundry containers and clean laundry containers may be supported by the main support frame. A laundry bag may be nestable in each soiled laundry container. Soiled laundry items may be placed in the laundry bags nested in the respective soiled laundry containers, (Continued)

which may allow to separate the laundry according to categories such as the owner of the laundry, or laundry item type. The laundry bags which contain the soiled laundry may be removed from the respective soiled laundry containers, closed, and placed in a laundry apparatus to wash and dry the laundry. Once clean, the cleaned and dried laundry may be removed from the laundry bag and placed in a corresponding one of the clean laundry containers for subsequent retrieval by the owner of the laundry.

28 Claims, 16 Drawing Sheets

(56) References Cited

U.S. PATENT DOCUMENTS 3,995,924 A * 12/1976 Jones ..... B65B 67/1227 312/211
4,585,283 A * 4/1986 Redmon ..... D06F 95/004 312/258
4,979,705 A * 12/1990 Bovitz ..... B65B 67/1238 248/97
5,118,173 A * 6/1992 Proctor ..... D06F 95/002 220/23.88
5,197,613 A * 3/1993 Kotlowski ..... A47F 5/0025 211/133.1
5,294,009 A * 3/1994 Maurer ..... B62B 3/006 280/47.35
5,544,781 A 8/1996 Mattesky
5,833,336 A * 11/1998 Dean ..... D06F 95/002 312/351
5,967,342 A * 10/1999 Steffine ..... D06F 81/00 211/85.15
6,032,965 A * 3/2000 Sabounjian ..... A47B 47/06 280/654
6,691,879 B1 * 2/2004 Alvarez ..... B62B 3/02 211/85.24
6,824,232 B2 11/2004 Farmer
8,910,813 B1 * 12/2014 Barre ..... D06F 95/002 220/528
D733,984 S * 7/2015 Tsai ..... D32/37
D768,348 S * 10/2016 Kellogg ..... D32/36
10,351,155 B1 * 7/2019 Thuma ..... B62B 3/02
D862,019 S * 10/2019 Liu ..... D32/37
10,906,706 B2 2/2021 Nilsson et al.
11,147,404 B1 * 10/2021 Duffy ..... A47B 43/003
D937,519 S * 11/2021 Tsai ..... D32/37
11,879,204 B2 * 1/2024 Duncan ..... D06F 95/004
12,091,813 B1 * 9/2024 Wilson ..... D06F 95/002
12,195,910 B2 * 1/2025 Abrams ..... A45C 13/103
12,325,951 B2 * 6/2025 Cleary ..... B01D 53/261
2003/0042826 A1 * 3/2003 Felsenthal ..... D06F 95/002 108/92
2005/0129337 A1 * 6/2005 Sabounjian ..... D06F 95/006 383/117
2006/0157358 A1 * 7/2006 Heidel ..... D06F 95/002 206/278
2006/0186187 A1 * 8/2006 Laher ..... B65F 1/163 232/1 B
2006/0255213 A1 * 11/2006 Lawson ..... D06F 95/004 248/95
2007/0200471 A1 * 8/2007 Boone ..... D06F 95/002 312/211
2009/0184117 A1 * 7/2009 Wang ..... D06F 95/004 220/9.2
2010/0071295 A1 3/2010 Wang
2013/0063012 A1 * 3/2013 Lu ..... B25H 3/06 312/334.7
2013/0154320 A1 * 6/2013 Byrd ..... A47D 15/00 297/219.12
2015/0083718 A1 * 3/2015 Barre ..... D06F 95/004 220/23.83
2015/0097091 A1 * 4/2015 Felsenthal ..... B65F 1/1468 248/97
2017/0254016 A1 * 9/2017 Barre ..... D06F 95/002
2021/0139064 A1 * 5/2021 Felsenthal ..... B62B 3/106
2022/0056633 A1 * 2/2022 Tuang ..... D06F 95/002
2023/0151538 A1 * 5/2023 Duncan ..... D06F 95/002 232/1 B
2023/0322428 A1 * 10/2023 Lawson ..... B65B 67/1216 248/95
2023/0383460 A1 * 11/2023 Davoudian ..... D06F 95/006
2024/0199320 A1 * 6/2024 Price ..... B65D 33/14
2024/0318378 A1 * 9/2024 Forgacs ..... D06F 95/004
2024/0384461 A1 * 11/2024 Zheng ..... B65B 67/1233

OTHER PUBLICATIONS

Chrome Metal Pullout Wire Clothes Hamper Basket with Linder and Mounting Hardware, The Home Depot, Jan. 29, 2021, homedepot.com/p/Rev-A-Shelf-Chrome-Metal-Pullo.

* cited by examiner

LAUNDRY SORTING AND PROCESSING SYSTEM AND METHOD

CROSS-REFERENCE TO RELATED APPLICATIONS

This application claims priority to and the benefit of U.S. Provisional Application No. 63/281,124 titled "LAUNDRY SORTING AND PROCESSING SYSTEM AND METHOD" and filed Nov. 19, 2021, which is incorporated herein by reference in its entirety.

FIELD OF THE TECHNOLOGY

The present disclosure relates generally to laundry accessories, and more particularly, to a laundry sorting and processing system which is simple in design, easy to assemble, and which enables a user to sort, process and organize laundry. The disclosure further relates to laundry sorting methods using the laundry sorting system.

BACKGROUND

Laundry washers and dryers are frequently used to clean clothing and other items made of cloth or other fabric. Such laundry appliances are typically stored in a laundry or utility room, closet, or other area in the home. Many utility rooms or other laundry areas in homes, however, are often small, poorly arranged, and inefficient.

In addition to the typical clothes washer and dryer, some laundry areas may include a built-in sink and cabinets. However, conventional laundry areas may lack space and facilities for performing sorting and storage of soiled clothes. Conventional laundry areas may also lack the space and facilities for sorting, processing, and organizing the cleaned and dried laundry.

In practice, conventional laundry practices are cumbersome, time-consuming, and often disorganized and require excessive space. In homes in which families reside, piles of clean clothing may be formed in one or more piles in the laundry area. Each member of the family may be required to search for his or her garments of clothing among the pile or piles.

Various types of equipment have been used to organize laundry after it is cleaned and dried. Some of these include sweater racks, accordion hanging racks, rolling shelves, rolling laundry carts, and the like. Many of these devices, however, may be inconvenient to store when not in use, or may be insufficiently dimensioned to optimize the space of the laundry area. Some types of laundry organizing equipment may require tools and/or mounting hardware for installation.

Accordingly, there is need for a laundry sorting and processing system which is simple in design, easy to assemble, and enables a user to sort, process, and organize laundry.

SUMMARY

The present disclosure is directed to a laundry sorting and processing system which is simple in design and easy to assemble and enables a user to sort, process and organize laundry. The laundry sorting and processing system may allow to separate soiled and clean laundry according to one or more categories such as, but not limited to, the owner of the laundry, the type of laundry item, etc. The laundry sorting and processing system may include soiled laundry and clean laundry containers and a plurality of preferably washable, laundry bags which may be removably placed inside the soiled laundry containers to receive soiled laundry, and thereafter be washed jointly with or separately from the soiled laundry. The laundry bags, the soiled laundry containers and/or the clean laundry containers may include an indicator used to distinguish the owner or user of the containers, the type of laundry items, etc. For example, the indicator may be a color of the laundry bags, the soiled laundry containers and/or the clean laundry containers that can be used to distinguish the owner or user of the containers, the type of laundry items, etc. The soiled laundry containers and clean laundry containers may be analogous, and may be interchangeable. While the laundry sorting and processing system could also be used in a laundry closet, laundry room, and/or utility space, this laundry sorting and processing system may be preferably targeted for use at a site of a user getting dressed. The site of a user getting dressed may most commonly be a bedroom or a closet attached to a bedroom. Further, based on many homes, apartments, and living spaces lacking the space or resources required for a dedicated laundry room, it is useful to incorporate the functions of such a dedicated space into existing furniture and existing spaces (such as closets) using the laundry sorting and processing system described herein.

In an illustrative implementation of the embodiments described herein, a laundry sorting and processing system which is simple in design and easy to assemble and enables a user to sort, process and organize laundry may include a main frame. A plurality of soiled laundry containers may be supported by the main frame. A plurality of clean laundry containers may be supported by the main frame beneath the respective soiled laundry containers. A plurality of laundry bags may be nestable in the respective soiled laundry containers. Each laundry bag may be sized and configured to receive a load of soiled laundry. The soiled laundry may be placed in the laundry bags nested in the respective soiled laundry containers, which may separate the laundry according to categories such as the owner of the laundry, for example. The laundry bags which contain the soiled laundry may be removed from the respective soiled laundry containers, closed and placed in a laundry washer/dryer to wash and dry the laundry. The laundry bag may be removed from the laundry washer/dryer, after which the cleaned and dried laundry may be removed from the laundry bag and placed in a corresponding one of the clean laundry containers for subsequent retrieval by the owner of the laundry.

In a second aspect, the laundry bags may be meshed.

In another aspect, the main frame may include a plurality of support posts and at least one container frame supported by the support posts, and the soiled laundry containers and clean laundry containers may be supported by the container frame.

In another aspect, each container frame may include a pair of elongated, parallel longitudinal frame members and a pair of elongated, parallel transverse frame members extending between the longitudinal frame members.

In another aspect, the container support frames and the soiled laundry containers and the clean laundry containers on the container support frames may be arranged in vertically spaced-apart laundry container rows on the main frame.

In another aspect, a frame panel may be supported by the longitudinal frame members and the transverse frame members of each container frame. The frame panel may separate the clean laundry containers from the soiled laundry containers in each laundry container row.

In another aspect, the frame panel of each container frame may include a plurality of elongated, parallel, spaced-apart frame panel members extending between the longitudinal frame members of the container frame.

In another aspect, frame collars may connect the transverse frame members to the longitudinal frame members of each container frame, and the support posts of the main frame may extend through the frame collars.

In another aspect, container access spaces may be disposed between the laundry container rows.

In another aspect, container rails (e.g., space-apart container rails and/or adjacent container rails) may be provided on each container frame, and each clean laundry container may slidably engage the container rails.

In another aspect, the container rails may include a first pair of side container rails and a middle container rail and/or a second pair of side container rails positioned between the first pair of side container rails.

In another aspect, each soiled laundry container may have a plurality of container sidewalls.

In another aspect, each soiled laundry container may include a container bottom, four container sidewalls, a container interior formed by the container bottom and the container sidewalls and a container flange included in and/or extending from the container sidewalls, and the container flange may engage the container rails. Any and/or all of the container sidewalls may be include one or more air vents.

In another aspect, each container rail may have a pair of connectors configured to engage the respective longitudinal frame members of each container frame. Examples of connectors can include rail hooks, removably couplable connectors (referred to herein as "quick attach" connectors), and/or screws (e.g. Chicago binding screws).

In another aspect, the laundry bags may include an indicator (e.g., color coding, bar code, QR code, label, etc.) to identify laundry corresponding to a particular owner of the laundry.

In another aspect, each laundry bag may be flexible, malleable and conformable to the size and shape of each soiled laundry container.

In another aspect, each laundry bag may include a laundry bag bottom, laundry bag sidewalls extending from the laundry bag bottom and a laundry bag interior formed by the laundry bag sidewalls and the laundry bag bottom.

In another aspect, a respective bag closure device may be carried by each laundry bag of the plurality of laundry bags, the bag closure device configured to secure said each laundry bag in a closed position.

In another aspect, a bag closure device may be provided on the laundry bag sidewalls of each laundry bag to secure the laundry bag in the closed position.

In another aspect, the bag closure device may include a flexible, securable closure strip.

In another aspect, the closure strip of the bag closure device may have a closure strip head and a closure strip slot sized and configured to receive the closure strip head in securement of the bag closure device.

In another aspect, a closure tether may connect the bag closure device to the laundry bag.

In another aspect, the soiled laundry containers and the clean laundry containers may be various sizes.

In another aspect, the soiled laundry containers and the clean laundry containers may be arranged in multiple columns.

In another aspect, the main frame of the laundry sorting and processing system may be configured as a piece of furniture, and the plurality of soiled laundry containers and the plurality of clean laundry containers may be carried by the piece of furniture.

In another aspect, wherein each soiled laundry container of the plurality of soiled laundry containers may include a container bottom, a plurality of container sidewalls, wherein at least one of the plurality of container sidewalls comprises an air vent, a container interior formed by the container bottom and the container sidewalls, and a pair of container flanges included in at least an opposite pair of container sidewalls of the plurality of container sidewalls. Each container flange of the pair of container flanges may extend along an opposite longitudinal direction of a respective container sidewall of the opposite pair of container sidewalls. Each container flange of the pair of container flanges may be configured to receive at least part (e.g., a sidewall) of one of the plurality of laundry bags.

In another aspect, the soiled laundry containers and clean laundry containers may be removable from the piece of furniture.

In another aspect, the piece of furniture may include a pair of spaced-apart sidewalls and a bottom wall and a top wall extending between the sidewalls, and the soiled laundry containers and the clean laundry containers may be insertable between the sidewalls and between the bottom wall and the top wall.

In another aspect, handle slots may extend through the respective sidewalls of the piece of furniture for carrying purposes. Any and/or all of the sidewalls may include one or more air vents.

The above and other preferred features, including various novel details of implementation and combination of events, will now be more particularly described with reference to the accompanying figures and pointed out in the claims. It will be understood that the particular systems and methods described herein are shown by way of illustration only and not as limitations. As will be understood by those skilled in the art, the principles and features described herein may be employed in various and numerous embodiments without departing from the scope of any of the present inventions. As can be appreciated from the foregoing and the following description, each and every feature described herein, and each and every combination of two or more such features, is included within the scope of the present disclosure provided that the features included in such a combination are not mutually inconsistent. In addition, any feature or combination of features may be specifically excluded from any embodiment of any of the present inventions.

The foregoing Summary, including the description of some embodiments, motivations therefor, and/or advantages thereof, is intended to assist the reader in understanding the present disclosure, and does not in any way limit the scope of any of the claims.

BRIEF DESCRIPTION OF THE DRAWINGS

The accompanying figures, which are included as part of the present specification, illustrate the presently preferred embodiments and together with the general description given above and the detailed description of the preferred embodiments given below serve to explain and teach the principles described herein.

Figure 1:
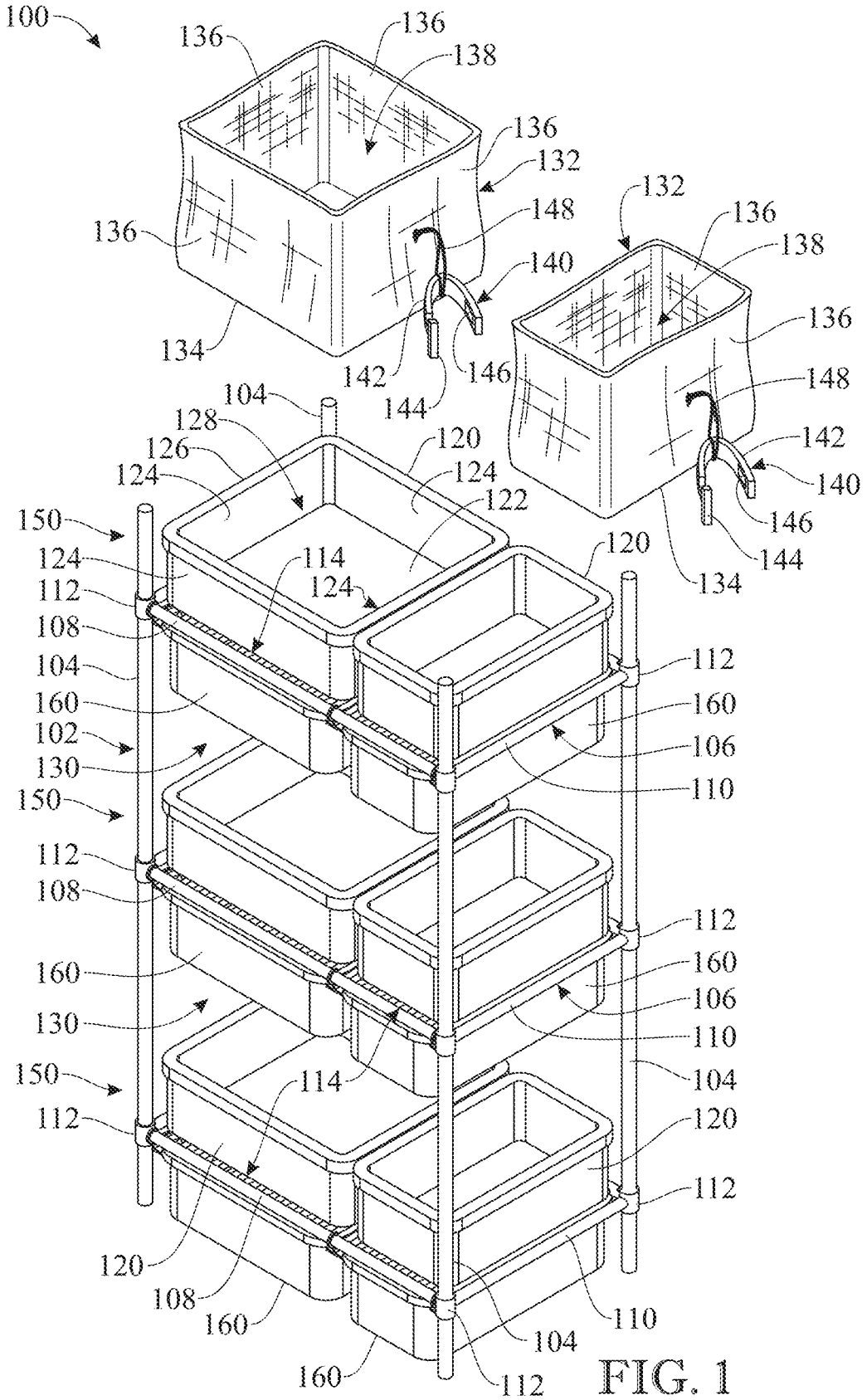
FIG. 1 presents a top front isometric view of a laundry sorting and processing system in accordance with a first illustrative embodiment of the present invention, more particularly showing a pair of laundry bags prior to being nested in a respective pair of soiled laundry containers.

Like reference numerals refer to like parts throughout the several views of the drawings. While the present disclosure is subject to various modifications and alternative forms, specific embodiments thereof have been shown by way of example in the drawings and will herein be described in detail. The present disclosure should not be understood to be limited to the particular forms disclosed, but on the contrary, the intention is to cover all modifications, equivalents, and alternatives falling within the spirit and scope of the present disclosure.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the system as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present disclosure is directed toward a laundry sorting and processing system which is easy to assemble and use, and enables a user to efficiently sort, process and organize laundry. The present disclosure also relates to laundry sorting and processing methods.

Referring initially to FIGS. 1-9, a laundry sorting and processing system 100 is illustrated in accordance with a first exemplary embodiment of the present invention. As shown for instance in FIGS. 1 and 2, the laundry sorting and processing system 100 may include a main frame 102. A plurality of soiled laundry containers 120 and a plurality of clean laundry containers 160 may be supported by the main frame 102. A plurality of laundry bags 132 may be received in the respective soiled laundry containers 120. In some embodiments, the laundry bags 132 may be meshed, or formed of a net- or mesh-like material. Each laundry bag 132 may be sized and configured to receive a load of soiled laundry 152 (FIG. 2) prior to washing and drying the laundry 152. The soiled laundry 152 may initially be placed in the laundry bags 132 nested in the respective soiled laundry containers 120. The soiled laundry containers 120 may separate the soiled laundry 152 according to categories such as the owner of the laundry 152, for example. The laundry bags 132 which contain the soiled laundry 152 may subsequently be removed from the respective soiled laundry containers 120, closed and placed in at least one laundry apparatus 156 (FIG. 8), such as a washing machine optionally followed by a tumble dryer, a two-in-one washing and drying machine, or the like, to wash and dry the laundry 152. After washing and drying, the laundry bag 132 may be removed from the laundry apparatus 156 and opened, after which the cleaned and dried laundry 152 may be removed from the laundry bag 132 and placed in a corresponding one of the clean laundry containers 160 for subsequent delivery to or retrieval by the owner of the laundry 152. As illustrated in FIGS. 1-4, in some embodiments, the clean laundry containers 160 may be supported by the main frame 102 beneath the respective soiled laundry containers 120. Each soiled laundry container 120 may be arranged above the corresponding one of the clean laundry containers 160. Elements of the laundry sorting and processing system 100 described herein may be comprised of materials such as metal (e.g., aluminum), plastic, composites, and/or wood. As an example, the container rails 166, 168 and associated connectors (e.g., rail hooks 170 or other connectors) may be comprised of and/or include plastic and may be configured to avoid permanent deformation (e.g., in order for the rails to be re-usable with the laundry sorting and processing system 100) when coupling and decoupling with the laundry sorting and processing system 100. The container rails 166, 168 and associated connectors may be temporarily deform during coupling and decoupling with the laundry sorting and processing system 100.

In different embodiments, the main frame 102 may have varying designs or constructions which are conducive to supporting the soiled laundry containers 120 and the clean laundry containers 160. For example and without limitation, and with reference to FIGS. 1 and 2, in some embodiments the main frame 102 may be formed by a plurality of legs supporting a plurality of shelves or container support frames. Specifically, the main frame 102 may include a plurality of vertical support posts 104. At least one container frame 106 may be supported by the support posts 104. Each of the one or more container support frames 106 may extend between the support posts 104, as shown for instance in the present embodiment. For example, the present embodiment includes three container support frames 106, spaced apart with one another and extending horizontally between the vertical support posts 104. The soiled laundry containers 120 and the clean laundry containers 160 may be supported by the at least one container frame 106. For example, as shown, a subset of soiled laundry containers 120 may be arranged on top of or resting on each container frame 106, and a corresponding subset of clean laundry containers 160 may be suspended from each container frame 106.

Figure 3:
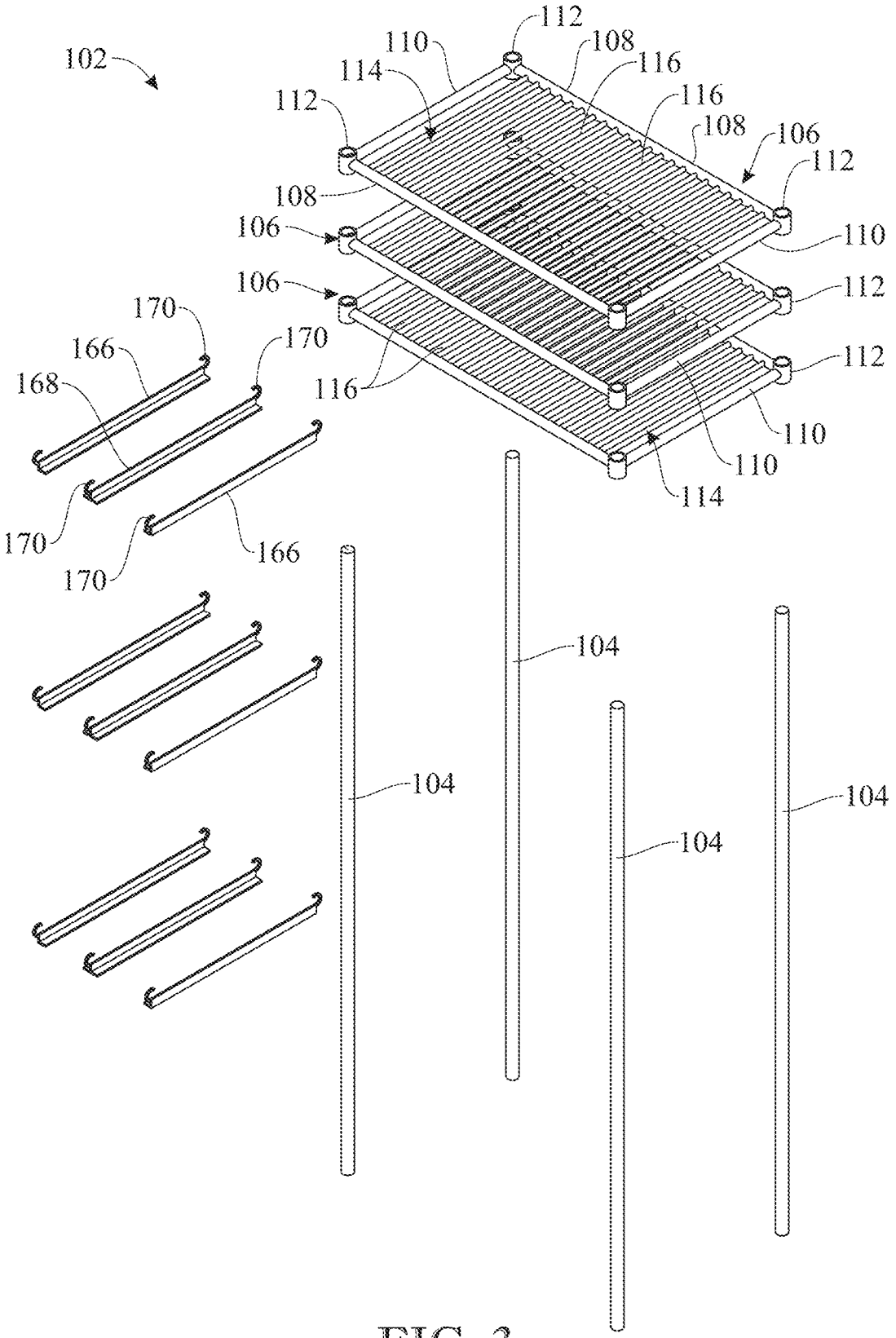
FIG. 3 presents an exploded, top front isometric view of a main frame of the laundry sorting and processing system of FIG. 1.

With reference to FIGS. 1 and 3, each container frame 106 of the main frame 102 may include a pair of elongated, parallel, spaced-apart longitudinal frame members 108. A pair of elongated, parallel, spaced-apart transverse frame members 110 may extend between the longitudinal frame members 108. The longitudinal frame members 108 and transverse frame members 110 may be arranged in perpendicular relationship and form a rectangular or square arrangement. Frame connectors or collars 112 may connect the transverse frame members 110 to the longitudinal frame members 108 of each container frame 106. The support posts 104 of the main frame 102 may extend through the frame collars 112.

As further shown in FIG. 1, in some embodiments, the container support frames 106, with the soiled laundry containers 120 and the clean laundry containers 160 carried by the container support frames 106, may be arranged in vertically spaced-apart laundry container rows 150 on the main frame 102. For instance, the depicted embodiment includes three laundry container rows 150. Each laundry container row 150 is formed by subset of soiled laundry containers 120 and a subset of corresponding clean laundry containers 160, carried by a same container frame 106; for instance, in the present embodiment, each container row 150 consists of two soiled laundry containers 120 and two clean laundry containers 160.

Alternatively or additionally to the longitudinal frame members 108 and the transverse frame members 110, each container frame 106 may include a frame panel 114. The frame panel 114 may separate the clean laundry containers 160 from the soiled laundry containers 120 in each laundry container row 150. Alternatively or additionally, the frame panel 114 may support the soiled laundry containers 120 and/or the clean laundry containers 160 in each laundry container row 150. In some embodiments, container access spaces 130 may be disposed between the laundry container rows 150 to facilitate access to the soiled laundry containers 120 in each laundry container row 150. The container access spaces 130 are formed between the soiled laundry containers 120 and the clean laundry containers 160 of each pair of adjacent laundry container rows 150.

In some embodiments, the frame panel 114 may be supported by and between the longitudinal frame members 108 and the transverse frame members 110 of each container frame 106. In some embodiments, the frame panel 114 may be a solid panel or board. In other embodiments, such as the present embodiment, the frame panel 114 may comprise at least one, and more preferably, a plurality of openings. For example, the frame panel 114 of each container frame 106 may include a plurality of elongated, parallel, spaced-apart frame panel members 116 which may extend between the longitudinal frame members 108 of the container frame 106, as shown for instance in FIG. 3. Alternatively, the frame panel members 116 may extend between the transverse frame members 110 of the container frame 106. In other embodiments, longitudinal and transverse frame members may extend both between the longitudinal frame members 108 and between the transverse frame members 110, in a crisscross or net-like pattern.

As mentioned heretofore, the clean laundry containers 160 may be carried by the corresponding container support frames 106. In some embodiments, each clean laundry container 160 may be slidably mounted with respect to each corresponding container frame 106. Container rails 166, 168 may be provided on each container frame 106. In some cases, the container rails 166, 168 may be spaced-apart. In some cases, the side container rails 166 may be spaced-together, such that a pair of side container rails 166 are adjacently positioned. Each clean laundry container 160 may slidably engage the container rails 166, 168. In some cases, a pair of spaced-together side container rails 166 may be used in place of a middle container rail 168. Each side container rail 166 may slidably engage with a single clean laundry container 160 at a time. Each middle container rail 168 may slidably engage with a pair of clean laundry containers 160 at a time. A pair of side container rails 166 may be placed in adjacent positions to replicate the functionality of the middle container rails 168 and slidable engage with a pair of clean laundry containers 160 at a time.

Figure 5:
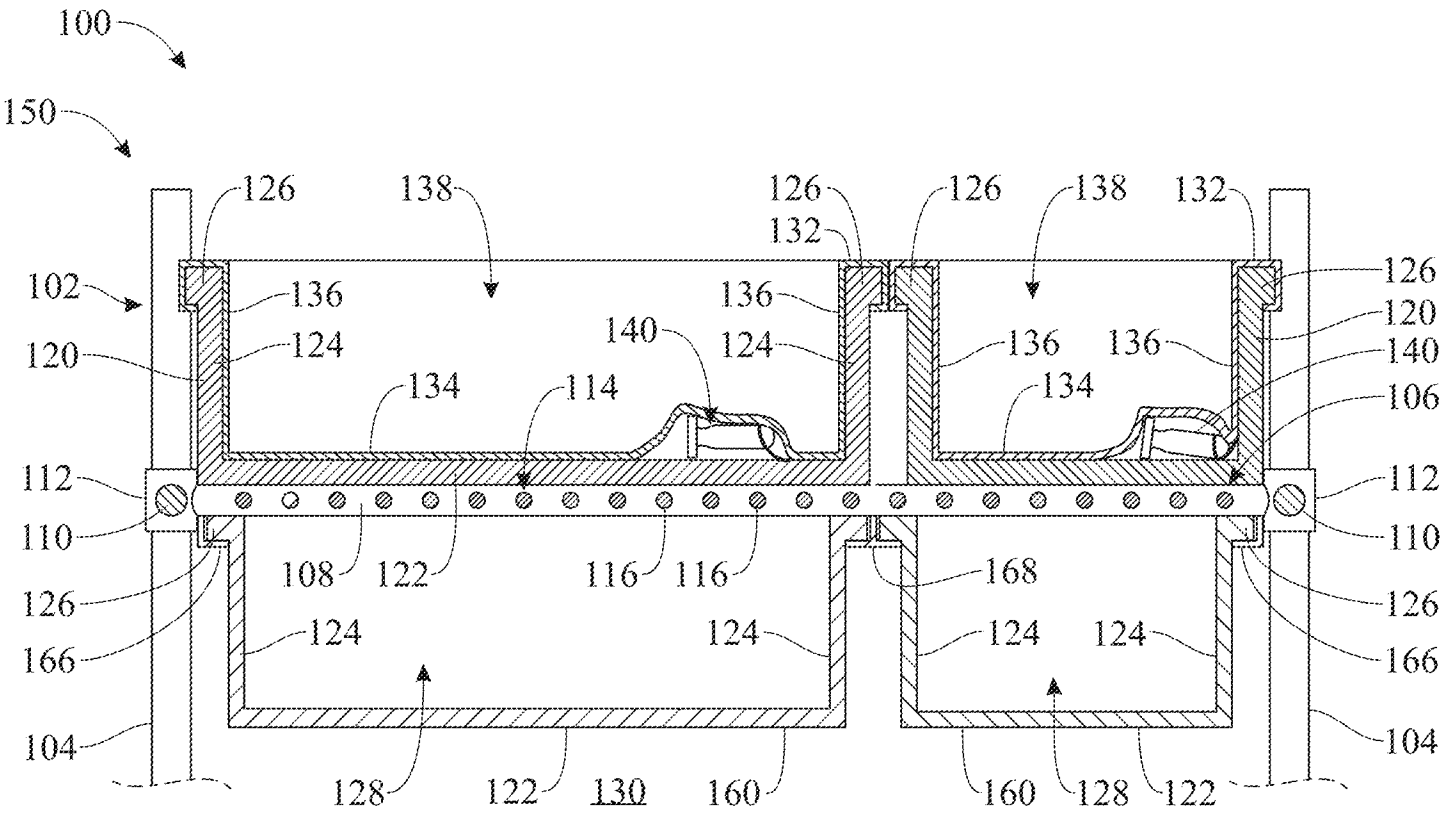
FIG. 5 presents a cross-sectional, front elevation view of a pair of soiled laundry containers and nested laundry bags of the top container row of the assembly of FIG. 2, the container row comprising a pair of clean laundry containers beneath the respective soiled laundry containers in accordance with an illustrative embodiment of the present invention.

As illustrated in FIG. 5, in some embodiments, the container rails 166, 168 may include a pair of parallel, side container rails 166. One or more pairs of side container rails 166 may be spaced-apart and/or spaced-together (e.g., adjacent) One or more middle container rails 168 may extend between the side container rails 166 in parallel, spaced-apart relationship thereto. In some cases, spaced-together side container rails 166 may extend between the side container rails 166 in parallel, spaced-apart relationship thereto in place of the middle container rails 168. The clean laundry containers 160 may slidably engage the side container rails 166 and/or the middle container rail 168. For instance, in the present embodiment, each laundry container row 150 includes two side container rails 166 and one middle container rail 168, configured to slidably support two clean laundry containers 160; each clean laundry container 160 is slidably mounted to the middle container rail 168 and to a respective one of the side container rails 166. In other embodiments, the laundry container row 150 may include additional middle container rails 168 and/or additional spaced-together side container rails 166 configured to slidably support additional clean laundry containers 160. Alternatively, the laundry container row 150 may include a single clean laundry container 160, and a pair of side container rails 166 configured to slidably support the single clean laundry container 160. In some cases, the container rails 166, 168 may each include one or more ball bearings configured to enhance an ability for the clean laundry containers 160 to slidably engage with the container rails 166, 168. The one or more ball bearings of each of the container rails 166, 168 may reduce friction between the respective side container rail 166 or middle container rail 168 and the clean laundry container 160 during slidable engagement as described herein. In some cases, the container rails 166, 168 may each include one or more roller bearings configured to enhance an ability for the clean laundry containers 160 to slidably engage with the container rails 166, 168. The one or more roller bearings of each of the container rails 166, 168 may reduce friction between the respective side container rail 166 or middle container rail 168 and the clean laundry container 160 during slidable engagement as described herein.

Figure 4:
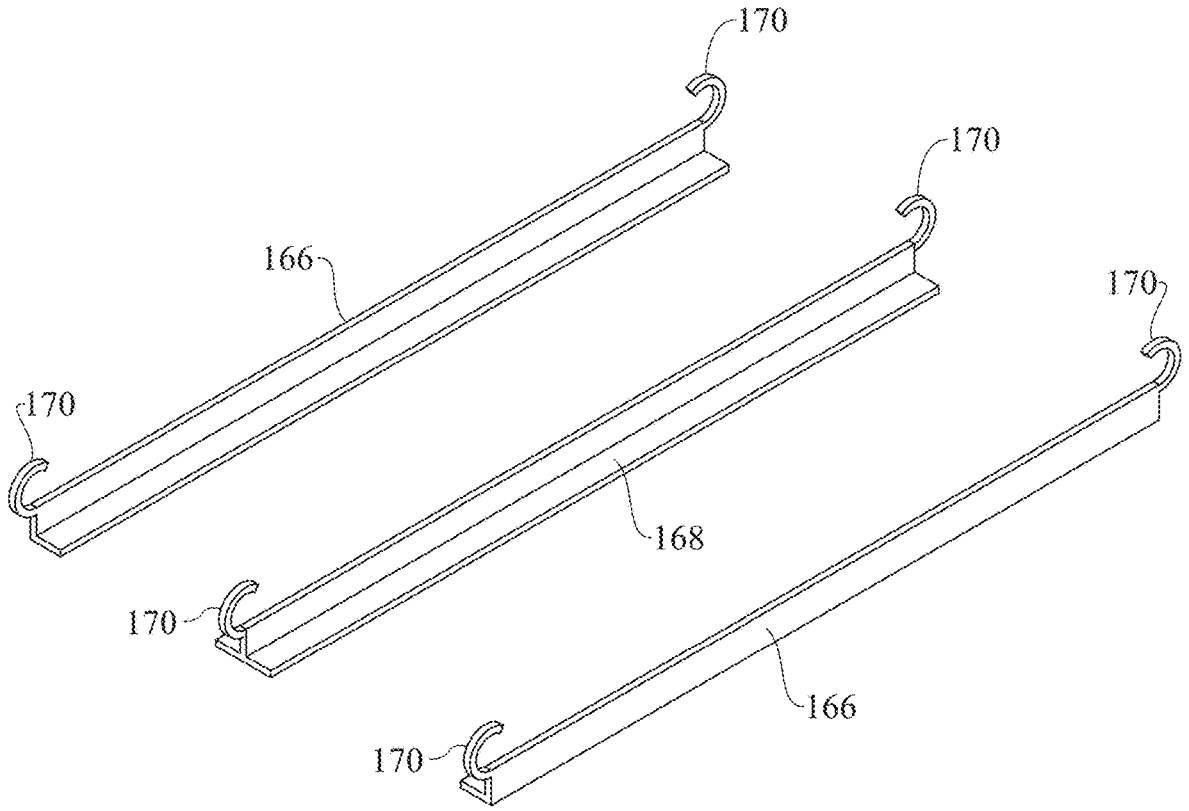
FIG. 4 presents a top front isometric view of a middle container rail and a pair of side container rails suitable for slidably mounting the clean laundry containers on the main frame in accordance with an illustrative embodiment of the present invention.

Each container rail 166, 168 may be mounted to the corresponding container frame 106. For example, as illustrated in FIG. 4, in some embodiments, each container rail 166, 168 may be terminated at its respective ends by a pair of rail hooks 170. The rail hooks 170 may be configured to engage the respective longitudinal frame members 108 of each container frame 106. Alternatively or additionally, the container rails 166, 168 may be attached to the container frame 106 by at least one screw (e.g., Chicago binding screw), bolt, magnet, snap-fit connection, strap, cord, and/or other applicable fastening means. In some embodiments, the container rails 166, 168 may be alternatively or additionally attached to the container frame 106 by one or more "quick attach" connectors (e.g., as described with respect to FIG. 15) that are configured to removably couple to the container frame 106. For example, a quick attach connector may be a strap that can removably couple the container rails 166, 168 to the container frame 106. In some embodiments, the container rails 166, 168 may be alternatively or additionally attached to the frame panel 114 by one or more screws (e.g., Chicago binding screws), bolts, hooks, straps, cords, magnets, and/or other applicable fastening means. In some embodiments, the container rails 166, 168 may be alternatively or additionally attached to the frame panel 114 by one or more quick attach connectors that are configured to removably couple to the frame panel 114. In some embodiments, the container rails 166, 168 may be alternatively or additionally attached to one or more of the panel members 116 by one or more quick attach connectors that are configured to removably couple to the panel members 116.

With reference to FIGS. 1 and 5, in some embodiments, the soiled laundry containers 120 and/or the clean laundry containers 160 may have a container bottom 122. A plurality of container sidewalls 124, such as four container sidewalls 124, may extend from the container bottom 122. A container interior 128 may be formed by the container bottom 122 and the container sidewalls 124. In some cases, a container bottom 122 may include an anti-microbial mat and/or an anti-microbial material covering at least some (e.g., all) of a surface of the container bottom 122 in the container interior 128. A container flange 126 may extend outwardly from the container sidewalls 124. In some embodiments, the container flange 126 may extend outwardly from left and right container sidewalls 124 and may slidably engage a corresponding one of the side container rails 166 and/or the middle container rail 168. Alternatively or additionally, the container flange 126 may extend outwardly from front and rear container sidewalls 124. For instance, in the present embodiment, the container flange 126 extends from all four container sidewalls 124 and along an entire perimeter of the containers. In some embodiments, such as the present embodiment, all of the soiled and clean laundry containers 120 and 160, respectively, include the aforementioned container bottom 122, container sidewalls 124, and container flange 126, and are interchangeably usable as soiled laundry containers or clean laundry containers.

In some embodiments, the container bottom 122 may include one or more air vents (e.g., holes, cutouts, etc.). The one or more air vents may enable airflow through the container bottom 122 and may enhance ventilation in the container interior 128. In some embodiments, one or more of the plurality of container sidewalls 124 may include one or more air vents. The one or more air vents may enable airflow through the container sidewalls 124 and may enhance ventilation in the container interior 128. In some embodiments, for soiled laundry containers 120 and/or clean laundry containers 160 having the same size and shape, the soiled laundry containers 120 and/or the clean laundry containers 160 may be stackable and/or nestable. For example, a first soiled laundry container 120 may be configured to nest within a container interior 128 of a second soiled laundry container 120, such that the first soiled laundry container 120 can be nested and stacked within the second soiled laundry container 120. Nesting and/or stacking capabilities for the soiled laundry containers 120 and/or the clean laundry containers 160 can enhance storage and organization of the soiled laundry containers 120 and/or the clean laundry containers 160 when the containers 120, 160 are removed from a corresponding container support frame 106.

Figure 2:
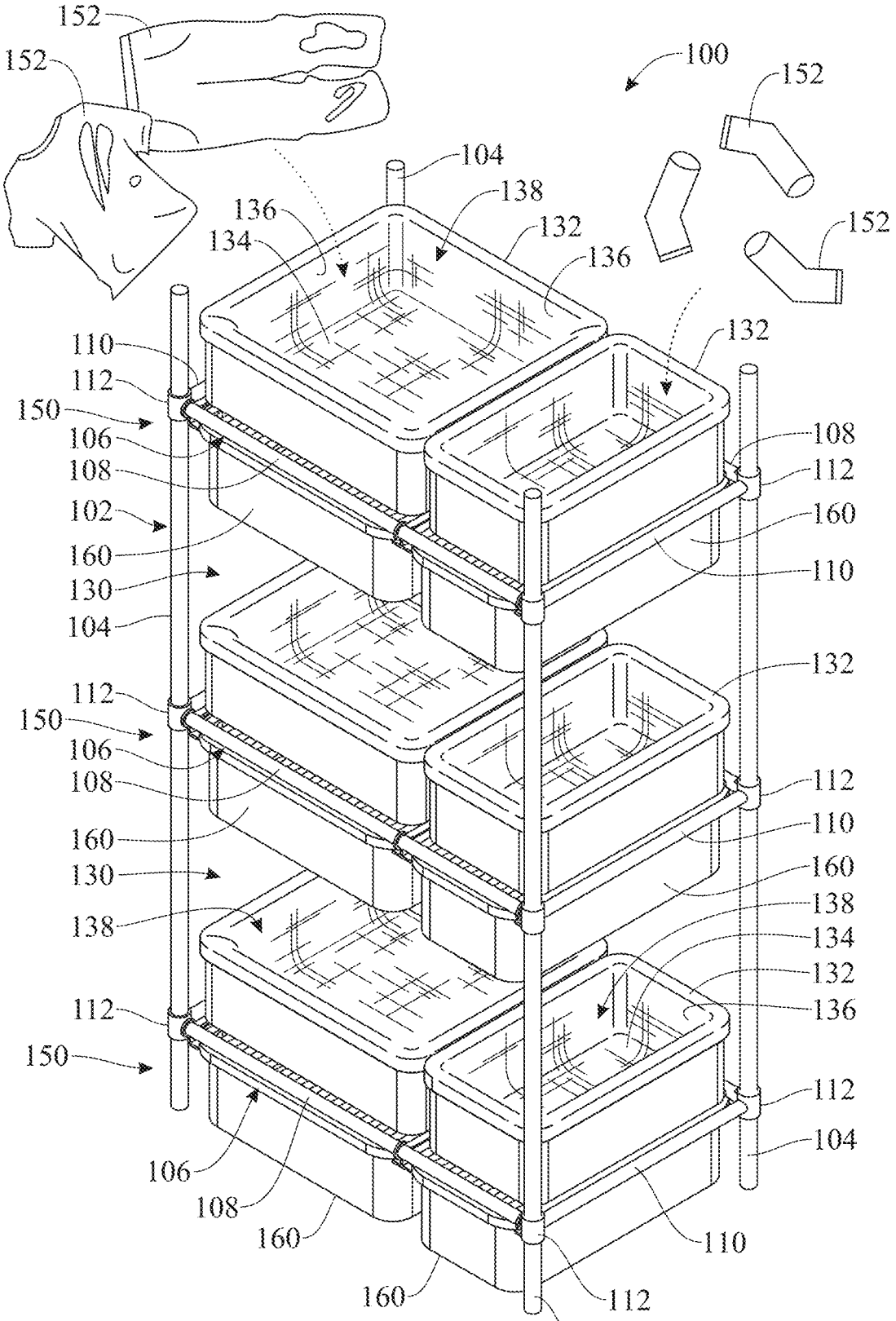
FIG. 2 presents a top front isometric view of the illustrative laundry sorting and processing system illustrated in FIG. 1, more particularly illustrating laundry bags placed in all soiled laundry containers, and further illustrating placement of different types of soiled laundry in different laundry bags.

In some embodiments, the laundry bags 132 may each include an indicator (e.g., a unique indicator) to identify the laundry 152 which is contained therein as corresponding to a particular owner of the laundry 152 and/or a particular type of laundry 152. In some cases, the indicator of the laundry bags 132 may be a color and the laundry bags 132 may be color coded to identify the laundry 152 which is contained therein as corresponding to a particular owner of the laundry 152 and/or a particular type of laundry 152. In some cases, the indicator of the laundry bags 132 may be a bar code, QR code, and/or a label, where each code or label identifies the laundry bags 132 and the laundry 152 which is contained therein as corresponding to a particular owner of the laundry 152 and/or a particular type of laundry 152. Each laundry bag 132 may include or be integrally made of a flexible, malleable mesh fabric material and conformable to the size and shape of each soiled laundry container 120. In some embodiments, as illustrated in FIGS. 1 and 2, each laundry bag 132 may be formed into a generally rectangular or otherwise-shaped body matching the generally rectangular or otherwise-shaped soiled laundry containers 120, and may include a laundry bag bottom 134, and laundry bag sidewalls 136 extending from the laundry bag bottom 134. A laundry bag interior 138 may be formed by the laundry bag sidewalls 136 and the laundry bag bottom 134. In some embodiments, the laundry bags 132 may be sized to have a volume that is approximately 2-10 times greater than a volume of a respective soiled laundry container 120 in which each laundry bag 132 is nested. For example, the laundry bags 132 may be sized to have a volume that is approximately 5 times greater than a volume of a respective soiled laundry container 120 in which each laundry bag 132 is nested.

In some embodiments, each laundry bag 132 may include a stretchable material which facilitates extension or stretching of the laundry bag sidewalls 136 over the edges of the soiled laundry container 120. For example, the flexible, malleable mesh fabric material may be stretchable such that the laundry bag 132 may be stretched over the edges of the soiled laundry container 120. Preferably, at least the top edge of the laundry bag 132 is elastically stretchable, such that when the top edge or top portion of the laundry bag 132 is stretched over the edges of the soiled laundry container 120, the top edge of the laundry bag 132 compresses against the soiled laundry container 120 and remains in place. In preferred embodiments, such as the present embodiment, the top portion of the laundry bag 132 is stretchable over the container flanges 126 and beyond (below) the container flanges 126, as shown in FIG. 5, such that it may elastically compress against the container flanges 126 on both a side and a bottom of the container flanges 126 while in use. In this way, the container flanges 126 may prevent the folded-over top portion of the laundry bag 132 from sliding upward towards the top opening of the soiled laundry container 120 and thereby prevent the laundry bag 132 from collapsing into the soiled laundry container 120.

Figure 7:
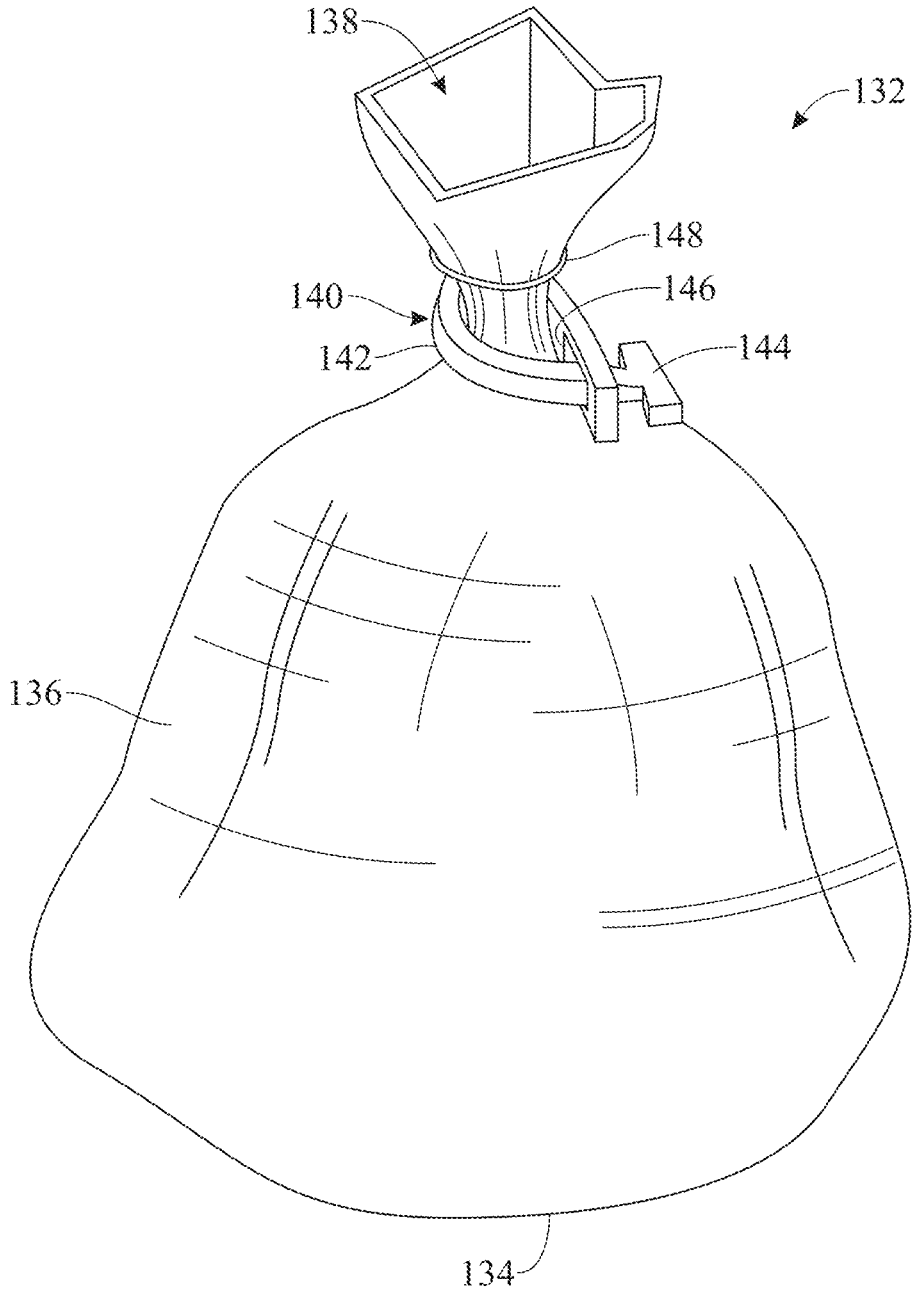
FIG. 7 presents a front perspective view of a laundry bag filled with soiled laundry and closed shut by deployment of a bag closure device on the laundry bag.

With continued reference to FIG. 1, in some embodiments, a bag closure device 140 may be provided on each laundry bag 132. For instance, the bag closure device 140 may be provided on one of the laundry bag sidewalls 136 of each laundry bag 132. The bag closure device 140 may be configured to secure the laundry bag 132 in a closed position. For instance and without limitation, the bag closure device 140 may include an elongated, flexible, securable closure strip 142 which may be rubber or plastic, for example and without limitation. A closure strip head 144 and a closure strip slot 146 may be provided in the closure strip 142. As illustrated in FIG. 7, the closure strip slot 146 may be sized and configured to allow the passage therethrough of the closure strip head 144 in securement of the bag closure device 140. The closure strip head 144 may be elastically deformable and compressible. The closure strip 142 may be switched from an initial, open position (FIG. 1) to a secured position (FIG. 7) by manually compressing the closure strip head 144 and passing the closure strip head 144 through the closure strip slot 146, and then releasing the closure strip head 144 to allow the closure strip head 144 to elastically expand such that it cannot slip back through the closure strip slot 146. In some embodiments, the closure strip 142 may be elastically deformable such that the closure strip 142 tends to adopt the initial open position (FIG. 1).

In some embodiments, a closure tether 148 may connect the bag closure device 140 to the laundry bag 132. The closure tether 148 may attach the bag closure device 140 to the laundry bag sidewall 136 of the laundry bag 132 at an intermediate point between an upper edge of the laundry bag sidewall 136 and the laundry bag bottom 134. As an example and without limitation, in some embodiments, the bag closure device 140 may be attached to the laundry bag sidewall 136 about 4 inches from the upper edge of the laundry bag sidewall 136. As another example and without limitation, in some embodiments, the bag closure device 140 may be attached to the laundry bag sidewall 136 about 10% of the length of the laundry bag 132 (e.g., defined as 10% of a height of the laundry bag sidewall 136) from the upper edge of the laundry bag sidewall 136. This expedient may prevent the bag closure device 140 from interfering with folding of the upper edges of the laundry bag sidewalls 136 over the edges of the soiled laundry container 120, and preferably over the container flanges 126 as described heretofore.

In different embodiments, the soiled laundry containers 120 may be identically or differently sized and shaped relative to one another, and the clean laundry containers 160 may be identically or differently sized and shaped relative to one another. Furthermore, within a same laundry container row 150, each soiled laundry containers 120 may be shaped and sized to match the corresponding clean laundry container 160 arranged therein below. For example and without limitation, in some embodiments, such as the present embodiment, each laundry container row 150 may include a relatively large, soiled laundry container 120 and an adjacent, relatively small soiled laundry container 120. A relatively large clean laundry container 160 and a relatively small clean laundry container 160 may be disposed beneath the respective large and small soiled laundry containers 120.

In an illustrative application of the laundry sorting and processing system 100, the main frame 102 may be assembled in a laundry room, utility room or other laundry area in a home or commercial establishment. In some applications, wall mounts (not illustrated) may be used to secure the main frame 102 to a wall (not illustrated) in the laundry area according to the knowledge of those skilled in the art. Once the main frame is assembled 102, at least one soiled laundry container 120 and at least one respective clean laundry container 160 may be arranged at one or more of the container support frames 106 to form one or more laundry container rows 150.

The laundry bags 132 may be nested in the respective soiled laundry containers 120 in one or more of the laundry container rows 150 on the main frame 102. As illustrated in FIGS. 2 and 5, the upper edges of the laundry bag sidewalls 136 of each laundry bag 132 (i.e. the top portion of each laundry bag 132) may be extended or stretched over the container flange 126 on the container sidewalls 124 of the soiled laundry container 120. As illustrated in FIG. 5, when the laundry bag 132 is deployed in the soiled laundry container 120, the tethered bag closure device 140 may remain outside and underneath the laundry bag 132, and thus will not interfere with the soiled laundry 152 that is placed inside the laundry bag 132. In consequence, the bag closure device 140 is readily available for use upon subsequent removal of the laundry bag 132 from the soiled laundry container 120.

As illustrated in FIG. 2, soiled laundry 152 may be placed in the laundry bag interior 138 of each nested laundry bag 132. In some applications, the soiled laundry 152 may be placed in the laundry bags 132 according to type of clothing, with shirts, shorts and socks placed in different laundry bags 132, for example and without limitation, to help prioritize the soiled laundry 152 for washing and drying. Alternatively or additionally, the soiled laundry 152 may be assorted and placed in the laundry bags 132 according to the owner of the soiled laundry 152. In some applications, the laundry bags 132 may include an indicator (e.g., unique indicator), where each particular indicator corresponds for instance to a particular owner of the soiled laundry 152 or user of the container, and/or to a type of laundry 152 (e.g., clothing versus socks) to be placed in each laundry bag 132. Alternatively or additionally, the soiled laundry containers 120 and/or clean laundry containers 160 may include indicators to distinguish them from one another (soiled versus clean), to identify a particular user of the container or owner of the soiled laundry 152 to be placed in the container, and/or to identify the type of laundry 152 that will be placed in the container. In some cases, the indicator of the laundry bags 132 may color coding, with each color of the laundry bags 132 corresponding for instance to a particular owner of the soiled laundry 152 or user of the container, and/or to a type of laundry 152 (e.g., clothing versus socks) to be placed in each laundry bag 132. Alternatively or additionally, the soiled laundry containers 120 and/or clean laundry containers 160 may be color coded to distinguish them from one another (soiled versus clean), to identify a particular user of the container or owner of the soiled laundry 152 to be placed in the container, and/or to identify the type of laundry 152 that will be placed in the container. Other examples of indicators include bar codes, QR codes, and labels.

Figure 6:
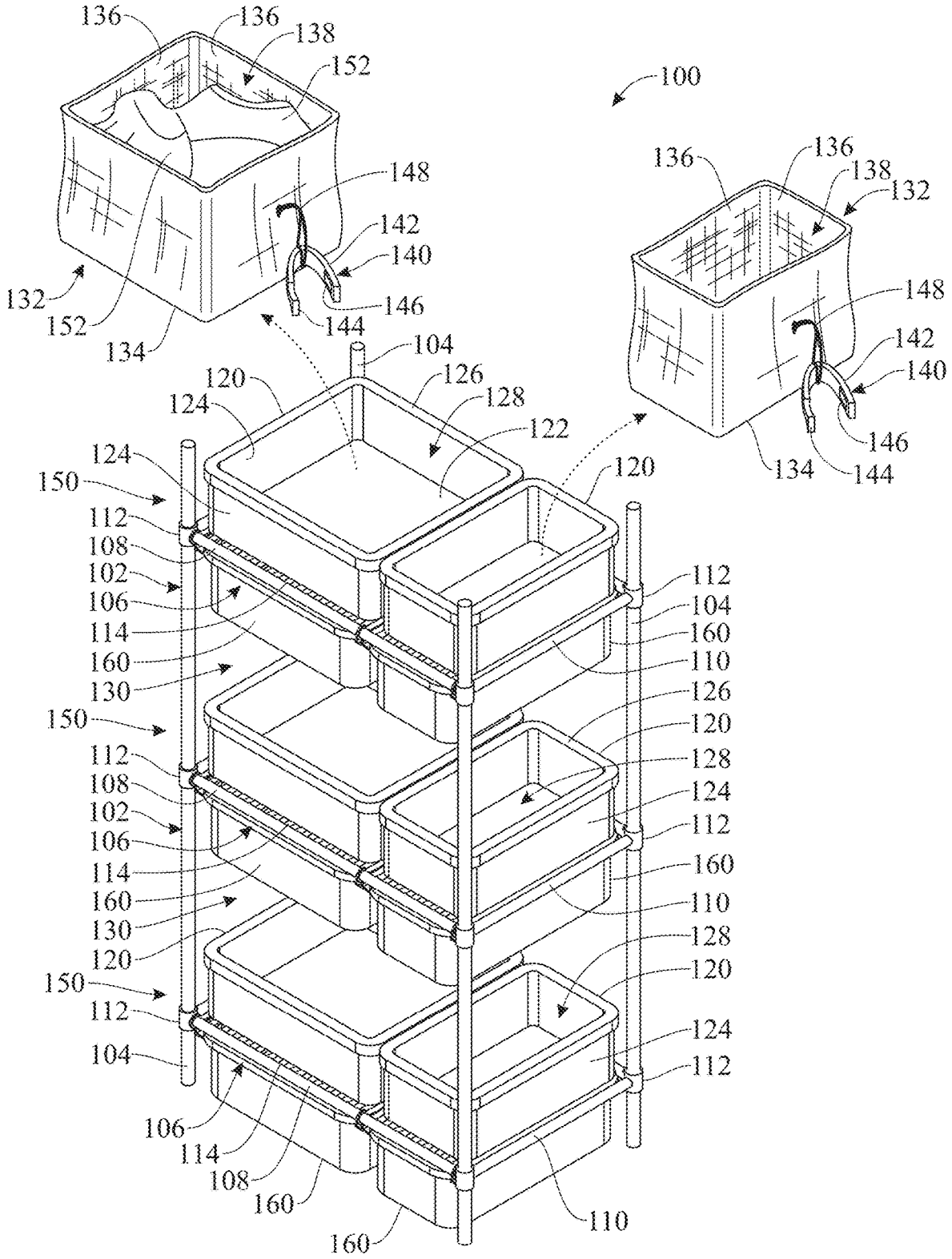
FIG. 6 presents a top front exploded isometric view of the illustrative laundry sorting and processing system of FIG. 1, more particularly illustrating removal of the nested laundry bags with soiled laundry therein from the respective soiled laundry containers.

As illustrated in FIG. 6, after each laundry bag 132 is filled, for instance, with a specific type of laundry 152 (clothing or socks) of a specific user, the laundry bag 132 may be lifted and removed from the container interior 128 of each corresponding soiled laundry container 120. As illustrated in FIG. 7, the filled laundry bag 132 may be closed, and the bag closure device 140 deployed to the securing position to secure the laundry bag 132 in the closed position.

Figure 8:
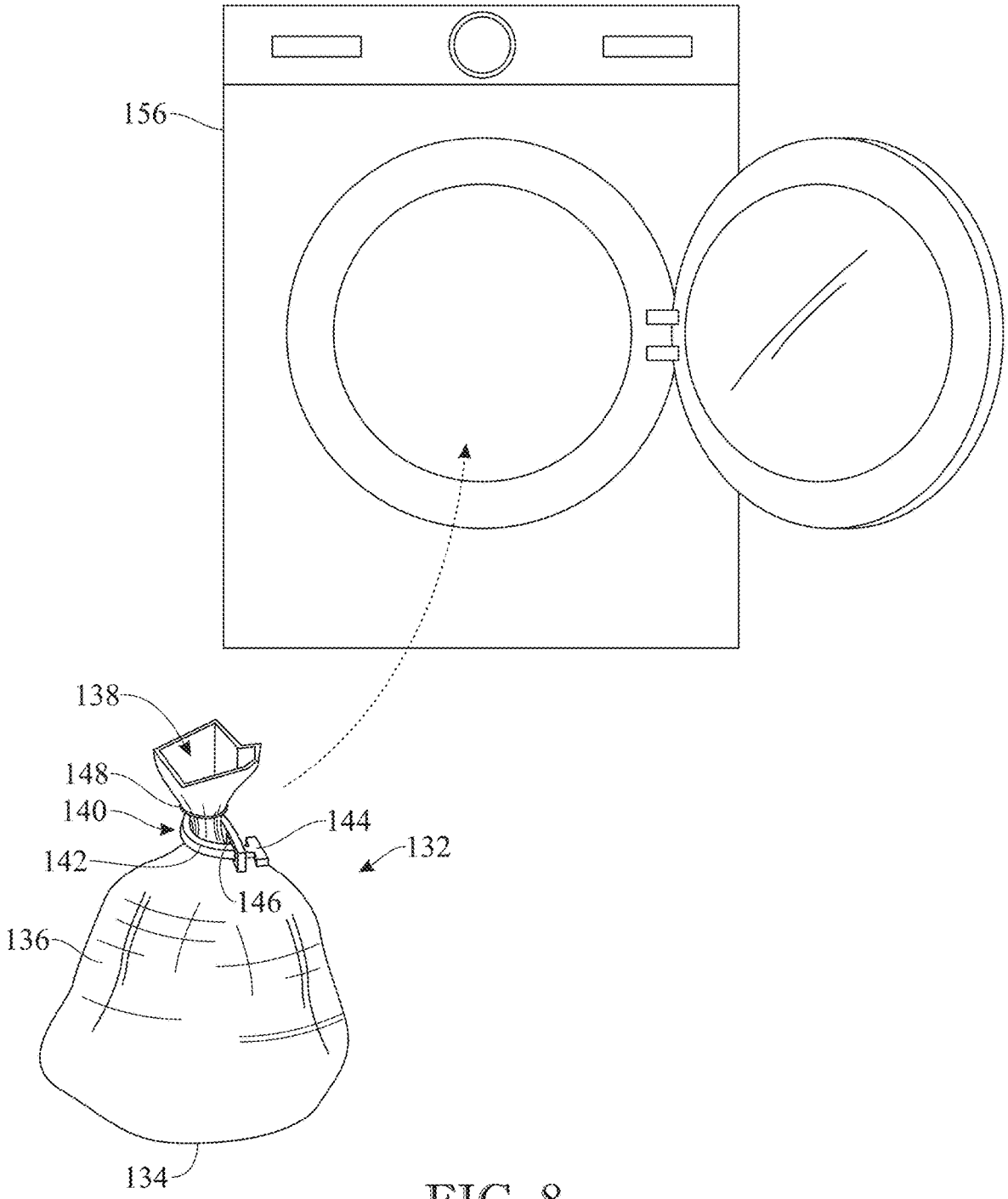
FIG. 8 presents a front view of a laundry apparatus, more particularly illustrating placement of the closed laundry bag illustrated in FIG. 7 in the laundry apparatus for joint washing and/or drying of the laundry bag and the laundry items contained therein.

As illustrated in FIG. 8, the filled laundry bag 132 may be placed in a laundry apparatus 156 and washed and dried, such as in a conventional manner. Alternatively, the soiled laundry 152 may be removed from the laundry bag 132 and placed in the laundry apparatus 156 and washed and dried. The emptied laundry bag 132 may be placed in the laundry apparatus 156 and washed and dried alongside and separately from the laundry 152. In some applications, when washing the laundry bag 132 jointly with the laundry 152 container therein, the laundry apparatus 156 may be operated on "extra dry" or higher heat settings to better dry the laundry bag 132 and the laundry 152 contained therein.

Figure 9:
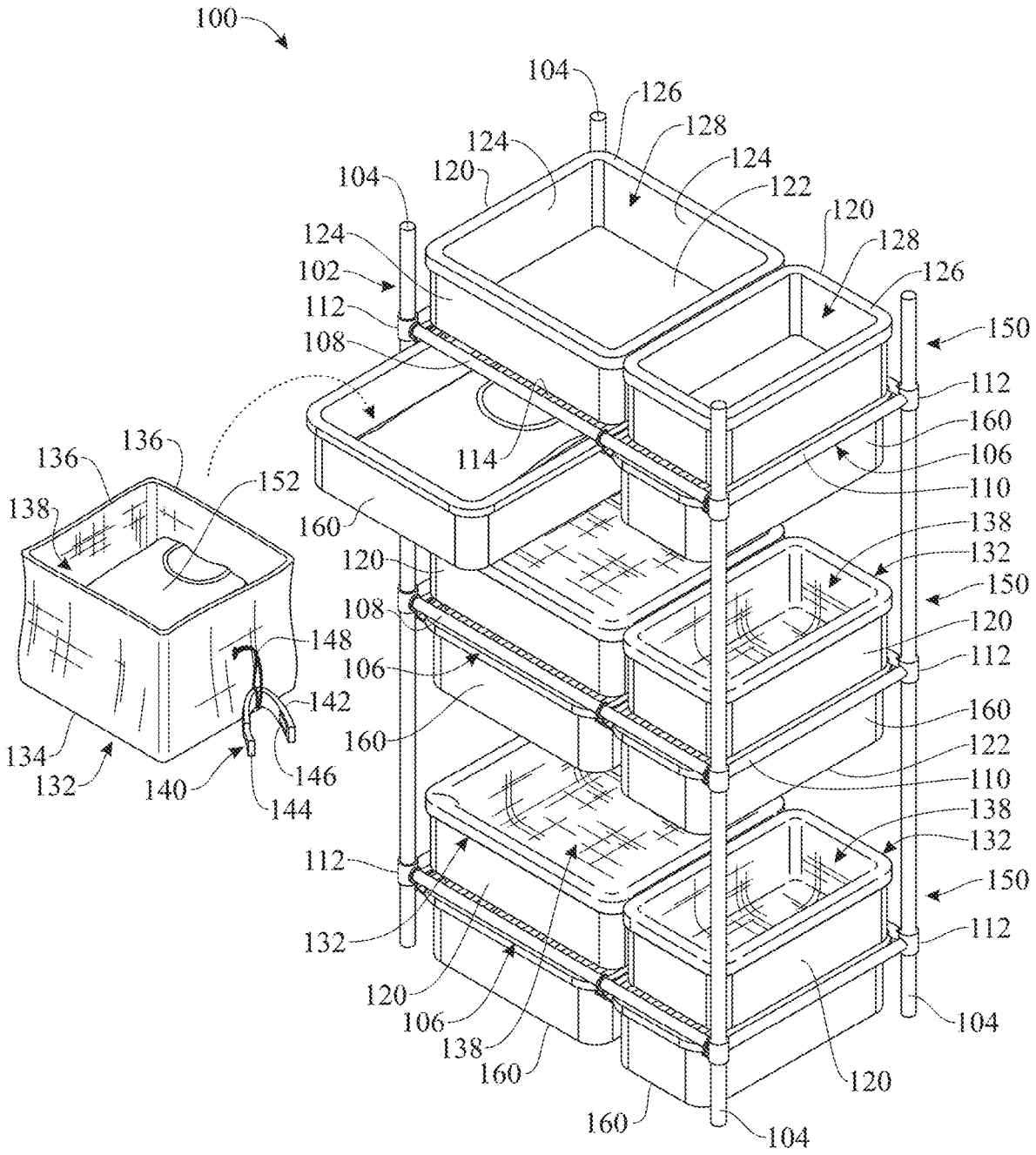
FIG. 9 presents a top front isometric view of the illustrative laundry sorting and processing system of FIG. 1, more particularly illustrating removal of clean laundry from an clean and opened laundry bag, and placement of the clean laundry in a clean laundry container.

As illustrated in FIG. 9, when washing and drying of the laundry 152 is completed, the laundry bag 132 having the cleaned and dried laundry 152 may be opened by disengagement of the bag closure device 140. In a first mode of operation, the cleaned and dried laundry 152 may be removed from the laundry bag 132 and placed in the clean laundry container 160, and the laundry bag 132 may then be nested in the soiled laundry container 120 for subsequent placement of soiled laundry 152 therein, as was heretofore described. In an alternative, second mode of operation, the clean laundry bag 132 with the cleaned and dried laundry 152 therein may be placed in a corresponding clean laundry container 160; in some embodiments, the clean laundry bag 132 may be folded over the container flanges 126 of the clean laundry container 160. In both modes of operation, the owner of the cleaned and dried laundry 152 may subsequently retrieve the laundry 152 from the clean laundry container 160, or alternatively, the laundry 152 may be delivered to the owner.

Figure 10:
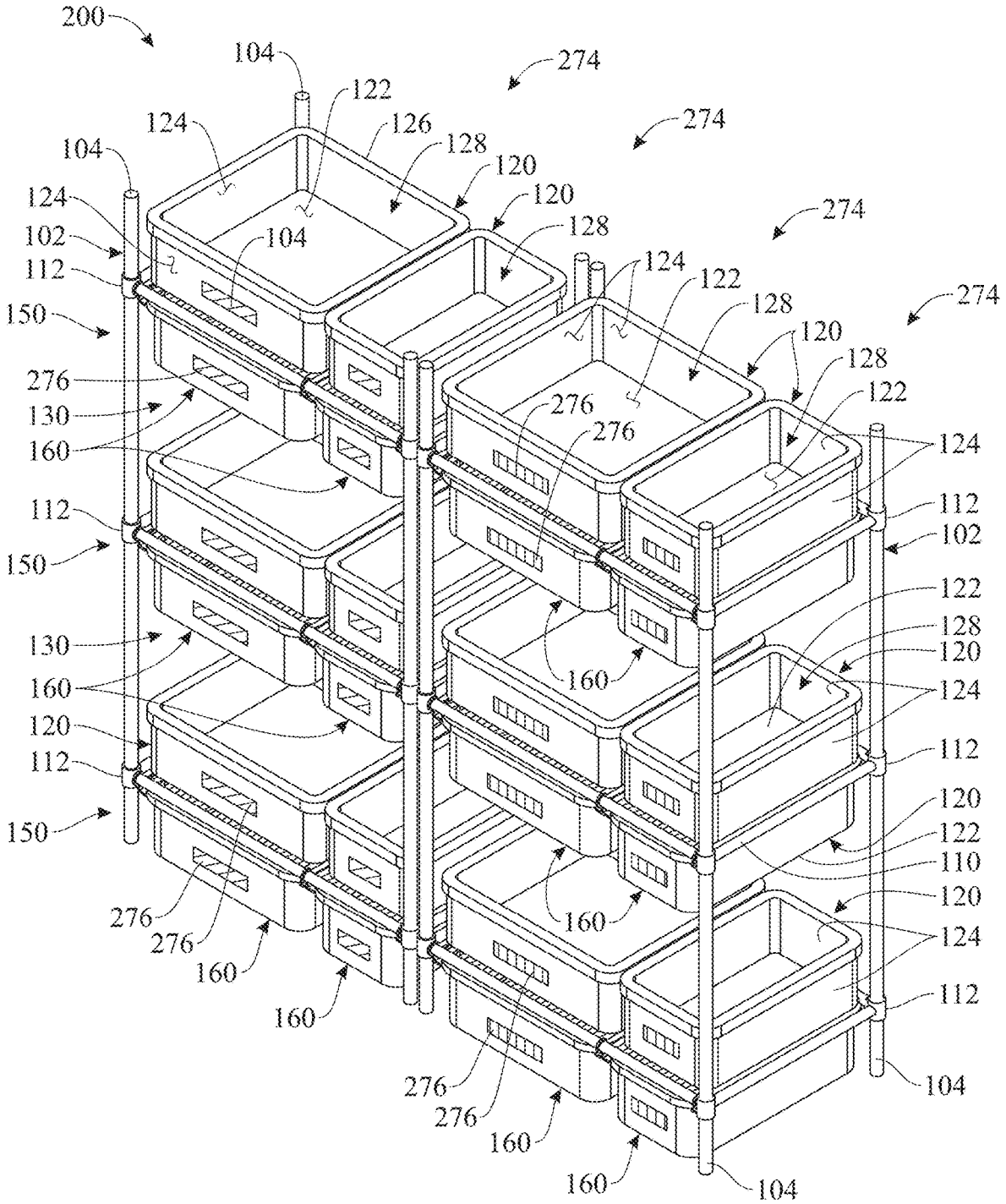
FIG. 10 presents a top front isometric view of a laundry sorting and processing system in accordance with a second illustrative embodiment of the present invention, the system including soiled laundry containers and clean laundry containers arranged in multiple columns.

Referring next to FIG. 10, an alternative illustrative embodiment of the laundry sorting and processing system is generally indicated by reference numeral 200. In the laundry sorting and processing system 200, elements which are analogous to the respective elements of the laundry sorting and processing system 100 that was heretofore described with respect to FIGS. 1-9 are designated by the same respective numerals. In the laundry sorting and processing system 200, the soiled laundry containers 120 and the clean laundry containers 160 may be arranged in multiple, adjacent container columns 274. Furthermore, container labels 276 may be provided on the respective soiled laundry containers 120 and/or clean laundry containers 160. The container labels 276 may indicate the name of the owner and/or other identifying indicia (e.g., QR codes, bar codes, etc.) for the laundry (not illustrated) contained in each corresponding soiled laundry container 220 and clean laundry container 260. While not expressly shown, it must be noted that the container labels 276 as described with reference to the present embodiment are also applicable to the remaining embodiments described in the present disclosure.

Application of the laundry sorting and processing system 200 of FIG. 10 may be as was heretofore described with respect to the laundry sorting and processing system 100 in FIGS. 1-9. The laundry sorting and processing system 200 may be suitable for use in sorting, processing and organizing laundry for a relatively larger number of persons in a home or commercial setting.

Figure 11:
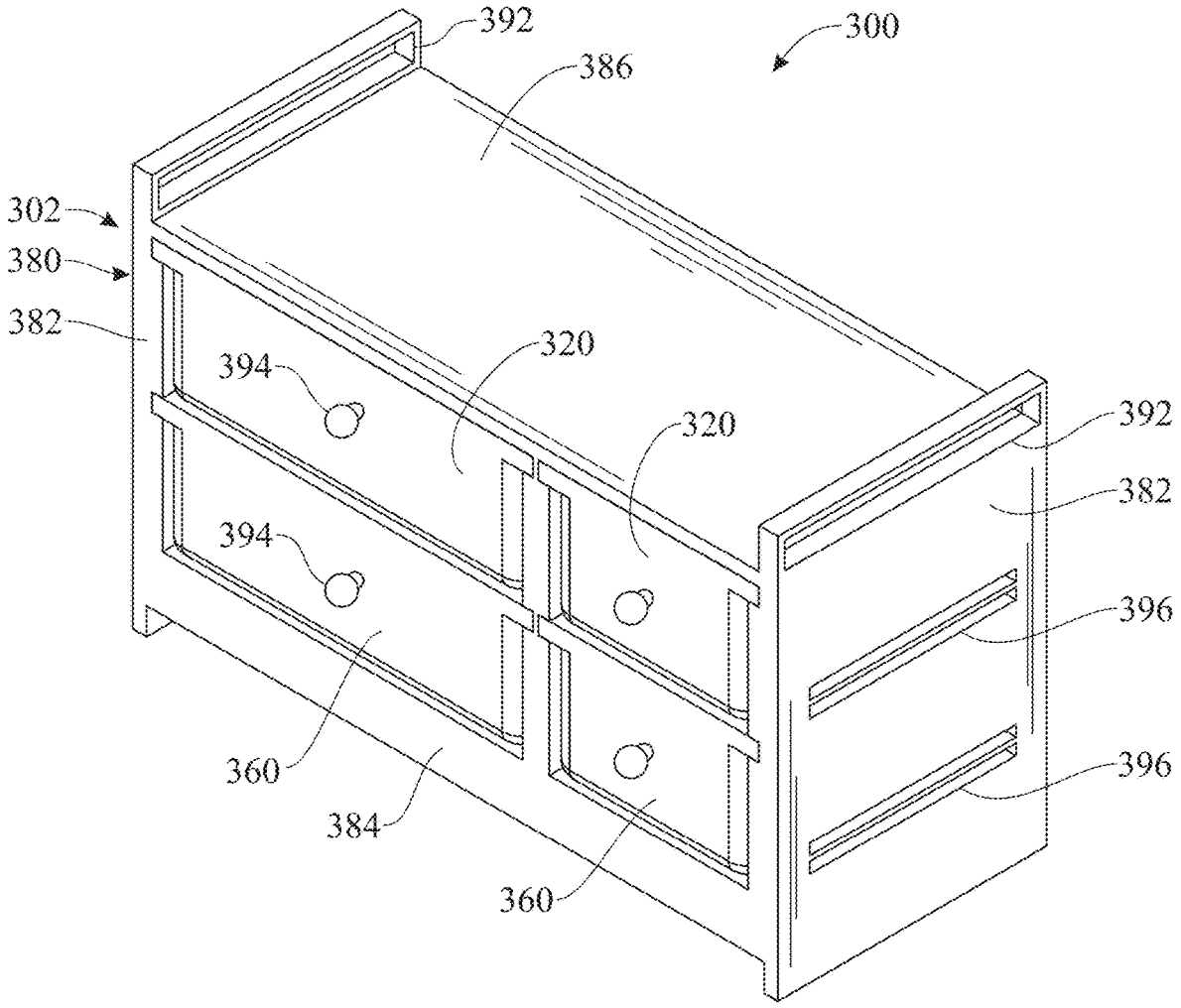
FIG. 11 presents a top front isometric view of a laundry sorting and processing system in accordance with a third illustrative embodiment of the present invention, the system including a main frame configured as a piece of furniture such as, but not limited to, a cabinet or dresser, with a plurality of soiled laundry containers and a plurality of clean laundry containers removable from the piece of furniture.
Figure 12:
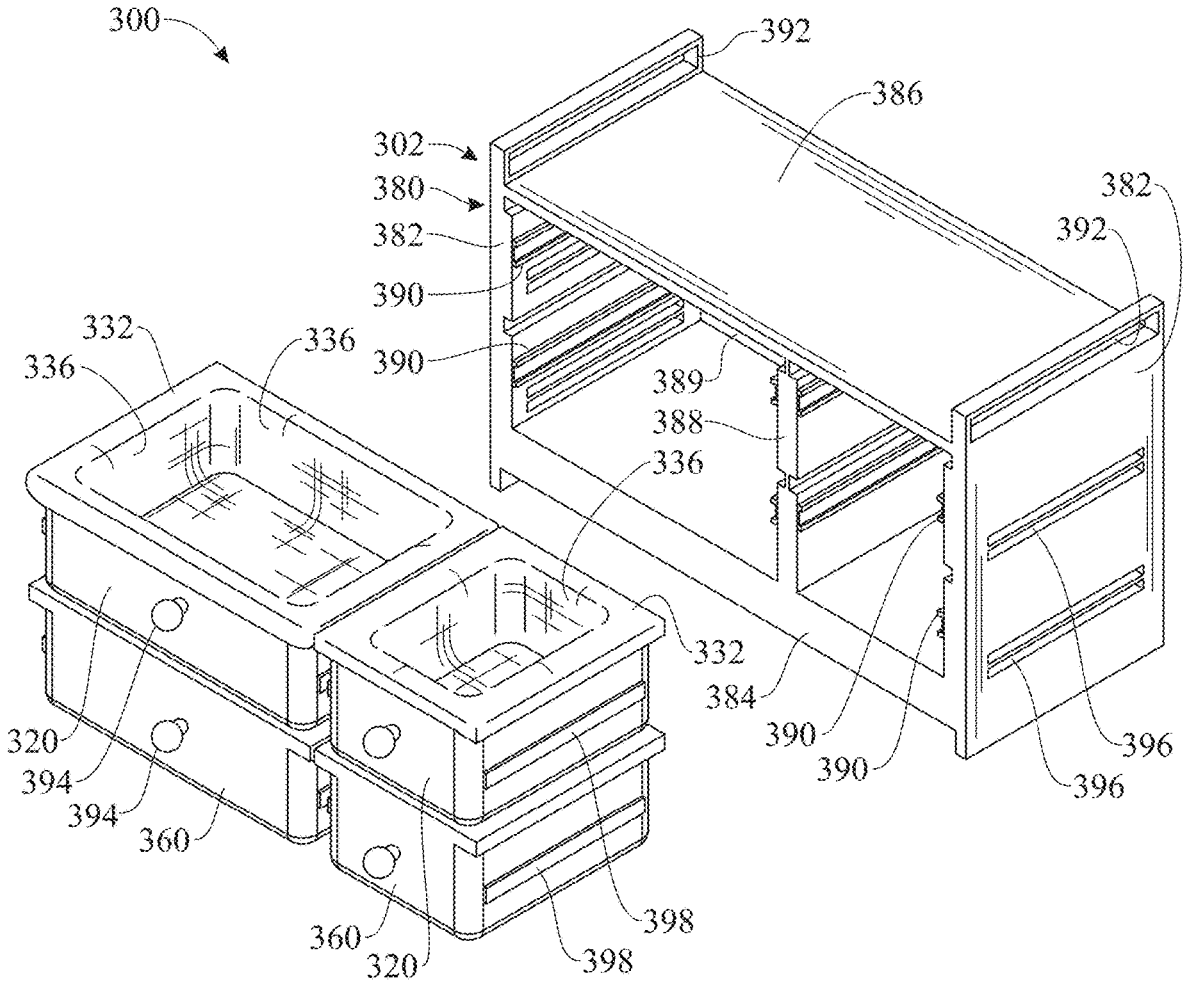
FIG. 12 presents a top front isometric view of the laundry sorting and processing system illustrated in FIG. 11, with the laundry containers shown extracted from the piece of furniture and a pair of laundry bags shown nested in a respective pair of soiled laundry containers.

Referring next to FIGS. 11 and 12, a laundry sorting and processing system 300 is shown in accordance with a third Illustrative embodiment of the present invention. In this embodiment, the laundry sorting and processing system 300 may include a main frame 302 which is configured as, or comprises, a piece of furniture 380 (also referred to as an "item of furniture" or a "furniture item"). In non-limiting examples, the piece of furniture 380 may resemble a cabinet, dresser, or chest of drawers. A plurality of soiled laundry containers 320 and a plurality of clean laundry containers 360 may be supported by the piece of furniture 380, and preferably selectively removable from the piece of furniture 380. The piece of furniture 380 may include a pair of spaced-apart sidewalls 382. A bottom panel or wall 384 and a top panel or wall 386 may extend between the sidewalls 382. A middle wall 388 may extend from the bottom wall 384 to the top wall 386 between the sidewalls 382. A rear wall 389 may extend from and between the top and bottom walls 386 and 384 and the sidewalls 382. In some embodiments, the sidewalls 382, and optionally all walls 382, 384, 386, 388 and 389 of the piece of furniture 380 may be generally solid, and at least one air vent 396 may extend through two or more walls of the piece of furniture 380, facilitating airflow through the interior of the piece of furniture 380. For instance, in the present embodiment, each sidewall 382 includes a plurality of air vents 396, facilitating airflow across the entire width of the piece of furniture 380. The air vents 396 may extend generally along an entire front-to-back dimension of the sidewalls 382, either continuously or discontinuously, to facilitate airflow along substantially the entire depth (front-to-back dimension) of the piece of furniture 380. In some embodiments, the plurality of air vents 396 may include louvers or other airflow adjustment mechanisms allowing to regulate the amount of air flowing through the piece of furniture 380. The soiled laundry containers 320 and the clean laundry containers 360 may be insertable between each corresponding sidewall 382 and the middle wall 388 and between the bottom wall 384 and the top wall 386. In some embodiments, at least one handle may be provided to facilitate transporting the piece of furniture 380; for example, handle slots 392 may extend through portions of the respective sidewalls 382 which extend upwardly beyond the top wall 386. In some applications, wall mounts (not illustrated) may be used to secure the piece of furniture 380 to a wall (not illustrated) in the laundry area according to the knowledge of those skilled in the art.

The soiled laundry containers 320 and the clean laundry containers 360 may be mounted for selective extension from the piece of furniture 380 or retraction into the piece of furniture 380. As illustrated in FIG. 12, in some embodiments, slide rails 390 may be provided on the interior surfaces of the respective sidewalls 382 and on the interior surfaces of the middle wall 388. Container rails 398 may be provided on the exterior side surfaces of each soiled laundry container 320 and each clean laundry container 360. The container rails 398 on the soiled laundry containers 320 and on the clean laundry containers 360 may engage the companion slide rails 390 in the piece of furniture 380 to jointly provide an extendable and retractable mechanism for extending and retracting the soiled and clean laundry containers 320 and 360 from the piece of furniture 380. A pull 394 may extend from or otherwise be formed in each soiled laundry container 120 and each clean laundry container 360, to facilitate pulling the containers out of the piece of furniture 380.

Application of the laundry sorting and processing system 300 may be as was heretofore described with respect to the laundry sorting and processing system 100 in FIGS. 1-9. Each soiled laundry container 320 and each clean laundry container 360 may be pulled and slid from the piece of furniture 380 for nesting of the laundry bag 332 therein, and depositing soiled or clean laundry. The air vents 396 may facilitate circulation of air between the interior and exterior of the piece of furniture 380 for venting of humidity and odors from the piece of furniture 380.

Figure 13A:
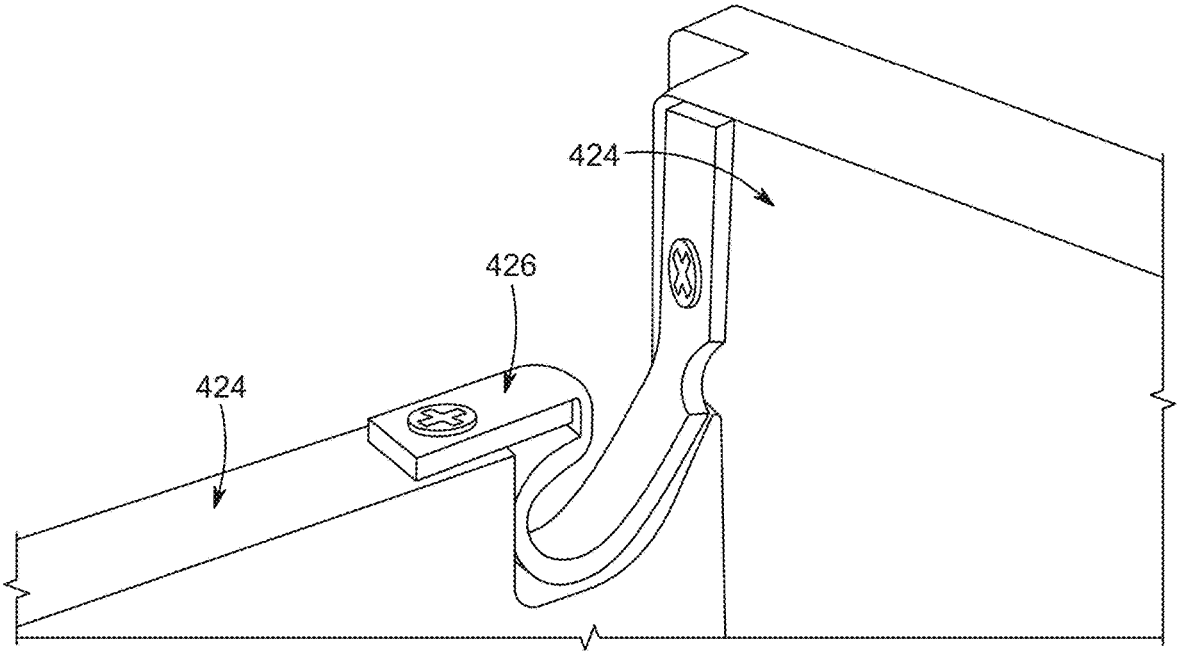
FIGS. 13A and 13B present views of illustrative container flanges included in container sidewalls of a laundry container.
Figure 13B:
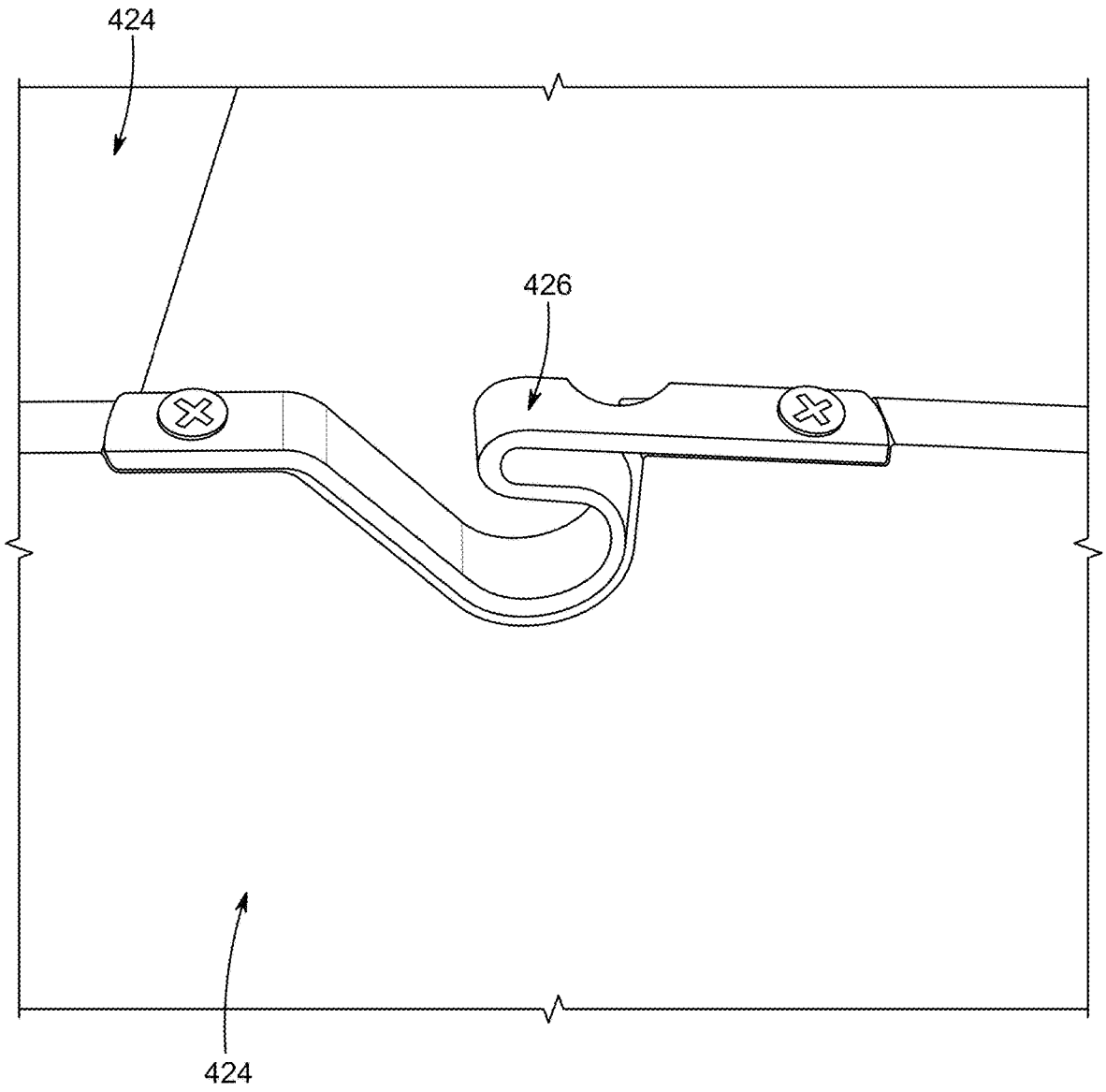

In some embodiments, container flanges (e.g., container flanges 126) as described herein may be included in container sidewalls of soiled laundry containers (e.g., soiled laundry containers 320). A container flange included in a container sidewall of a laundry container may extend along a longitudinal axis of the respective container sidewall, such that the container flange is inside and/or otherwise contained within the container sidewall. A container flange may be included in a container sidewall in place of and/or in addition to a container flange extending outwardly from the container sidewall. FIGS. 13A and 13B present illustrative container flanges included in sidewalls of a laundry container (e.g., a soiled laundry container 320). FIG. 13A presents a front illustrative container flange 426 included in a sidewall 424 of a laundry container. FIG. 13B shows a back illustrative container flange 426 included in a sidewall 424 of a laundry container. In some cases, a pair of container flanges 426 may be included in a sidewall 424 of a soiled laundry container (e.g., soiled laundry container 320). As shown in FIGS. 13A and 13B, the container flanges 426 may be embedded in (e.g., cut out of) a container sidewall 424 and may not extend outward from the container sidewall 424. The pair of container flanges 426 may extend along opposite longitudinal directions of the sidewall 424. In some embodiments, the container flange 426 may extend along opposite longitudinal directions in each of left and right container sidewalls 424. Alternatively or additionally, the pair of container flanges 426 may extend along opposite longitudinal directions in each of front and rear container sidewalls 424.

In some embodiments, the container flanges 426 may have a width equivalent to and/or less than a width of a container sidewall 424. In some cases, a width of the container flanges 426 may be required to be at least three times a width and/or a diameter of voids (e.g., holes) included in a mesh material of a laundry bag (e.g., laundry bag 132) as described herein. The width of the container flanges 426 being sufficiently (e.g., at least three times) greater than a width and/or a diameter of voids included in a mesh material of a laundry bag may reduce wear and/or abrasion on the laundry bag.

In some embodiments, as was heretofore described with respect to the laundry sorting and processing system 100 in FIGS. 1-9, a top edge of the laundry bag 332 is elastically stretchable, such that when the top edge or top portion of the laundry bag 332 is stretched over at least some of the edges of the soiled laundry container 320, the top edge of the laundry bag 332 compresses against the soiled laundry container 320 and remains in place. In some embodiments, the soiled laundry container may include container flanges 426, such that when the top edge or top portion of the laundry bag 332 is stretched over the container flanges 426 of the soiled laundry container 320, the top edge of the laundry bag 332 compresses against the soiled laundry container 320 and remains in place. In some cases, the top portion of the laundry bag 332 is stretchable over the container flanges 426 of the solid laundry container 320 and beyond (below) the container flanges 426, such that it may elastically compress against the container flanges 426 on both a side and a bottom of the container flanges 426 while in use. In this way, the container flanges 426 may prevent the folded-over top portion of the laundry bag 332 from sliding upward towards the top opening of the soiled laundry container 320 and thereby prevent the laundry bag 332 from collapsing into the soiled laundry container 320. In some cases, the container flanges 426 of the solid laundry container 320 may be of sufficient tensile strength as to substitute for the material (e.g., wood) used in the piece of furniture 380. In some cases, the container flanges 426 extend a lifespan of a laundry bag 332 by preventing unnecessary wear.

In some embodiments, all of the soiled and clean laundry containers, respectively, include the aforementioned container bottom, container sidewalls 424, and container flange 426, and are interchangeably usable as soiled laundry containers or clean laundry containers.

Figure 14:
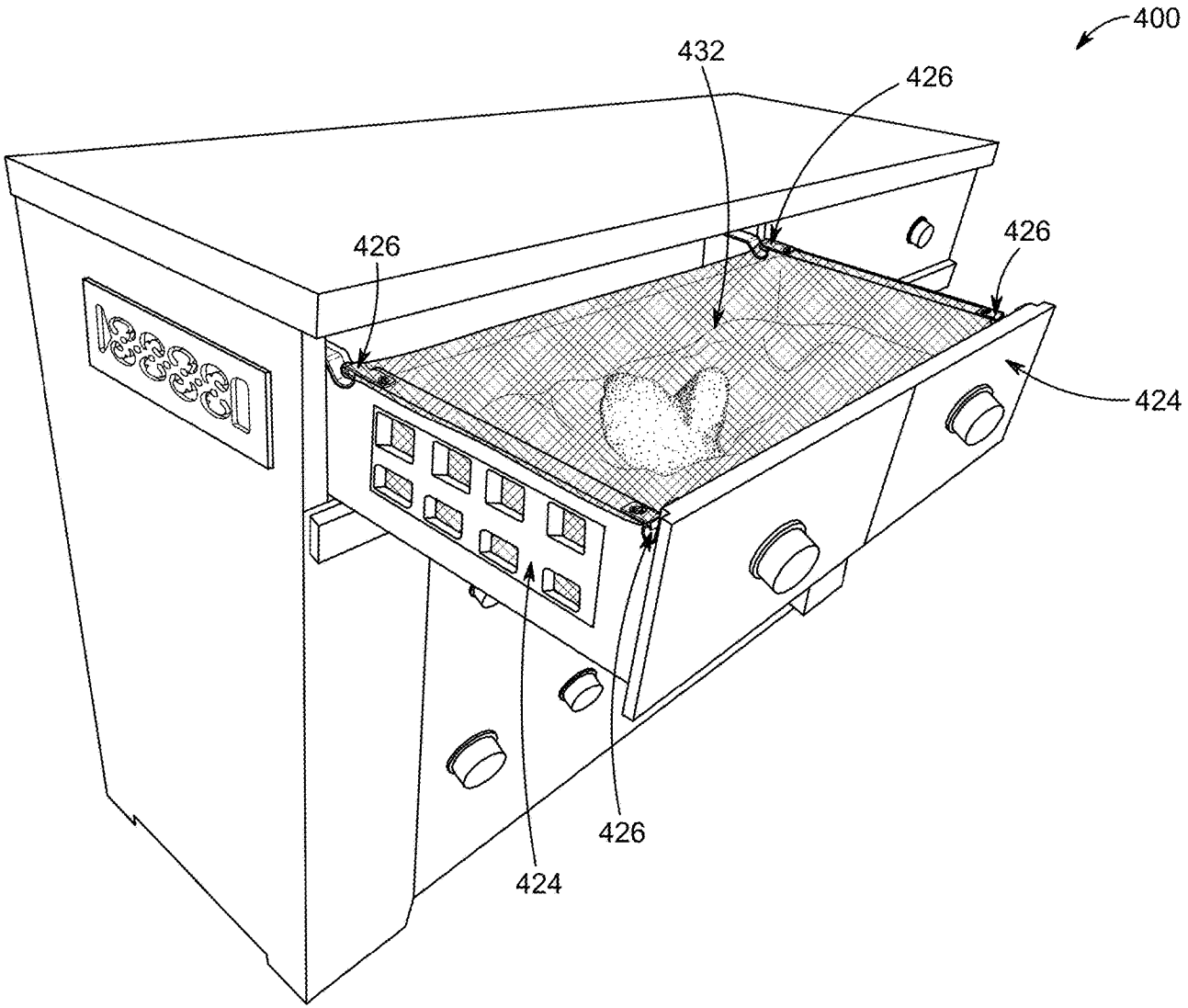
FIG. 14 presents a view of a laundry sorting and processing system in accordance with the third illustrative embodiment of the present invention.

FIG. 14 presents a view of a laundry sorting and processing system 400 in accordance with the third illustrative embodiment of the present invention. One or more elements of the laundry sorting and processing system 400 may be analogous to the respective elements of the laundry sorting and processing system 300 that was heretofore described with respect to FIGS. 11 and 12. In this embodiment, one or more sidewalls 424 of soiled laundry containers of the laundry sorting and processing system 400 may include container flanges 426 as described herein (e.g., with respect to FIGS. 13A and 13A). As shown in FIG. 14, the left and right container sidewalls 424 of the soiled laundry container each include a pair of flanges 426 extending in opposite longitudinal directions of the respective container sidewall 424. The container flanges 426 are embedded in the respective container sidewalls 424 and do not extend outward from an edge of the respective container sidewalls 424. Each container flange 426 extends inward in a direction of a closest edge of a longitudinal side of a container sidewall 424. The container flanges 426 may replicate a functionality of the container flanges 126 to engage with edges of a laundry bag as described with respect to FIGS. 1-10. The container flanges 426 may be adapted for the third embodiment of the laundry sorting and processing system (e.g., 300 and/or 400) by not slidably engaging with slide rails (e.g., slide rails 390) of the launder sorting and processing system. As shown in FIG. 14, a top edge or top portion of a laundry bag 432 may engage with the container flanges 426 and the edges of the left and ride container sidewalls 424, without engaging with the edges of front and back container sidewalls.

Figure 15:
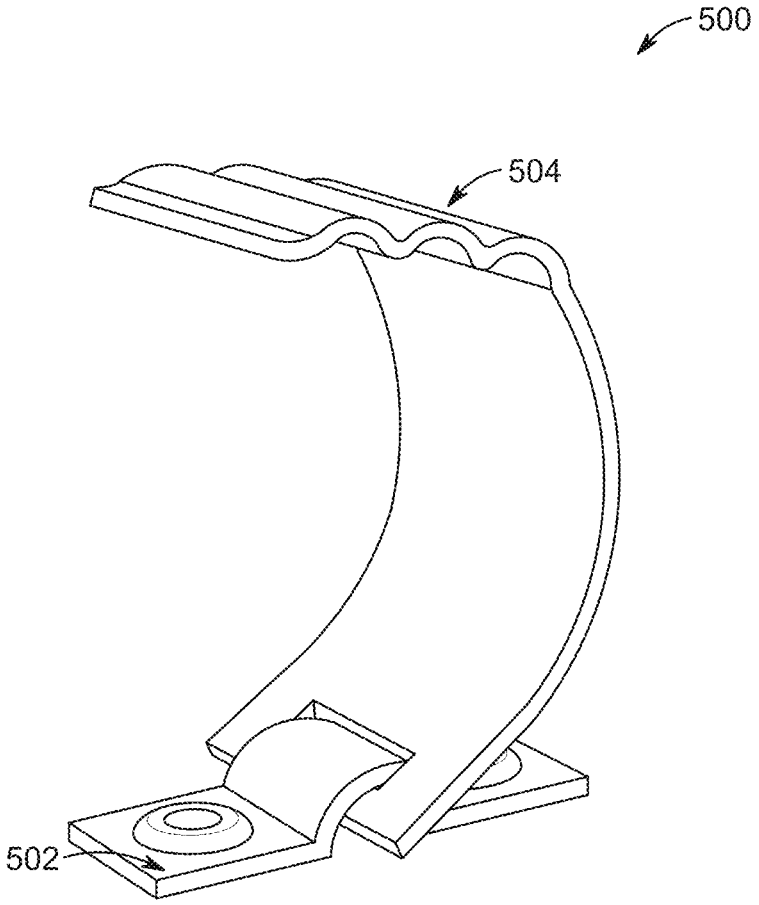
FIG. 15 presents a view of an illustrative connector.

FIG. 15 presents a view of an illustrative connector 500. The connector 500 may be a "quick attach" connector as described herein. In some embodiments, container rails (e.g., container rails 166, 168) as described herein may include one or more connectors 500, where the connectors 500 are coupled to the container rails by an anchor 502. In some embodiments, container rails may be attached to a container frame (e.g., container frame 106) and/or a frame panel (e.g., frame panel 114) by one or more connectors 500 that are configured to removably couple to the container frame and/or the frame panel. As shown in FIG. 15, the connector 500 may include a strap 504 than can removably couple to the container support frame and/or the frame panel.

Terminology

The phrasing and terminology used herein is for the purpose of description and should not be regarded as limiting.

Measurements, sizes, amounts, and the like may be presented herein in a range format. The description in range format is provided merely for convenience and brevity and should not be construed as an inflexible limitation on the scope of the invention. Accordingly, the description of a range should be considered to have specifically disclosed all the possible subranges as well as individual numerical values within that range. For example, description of a range such as 1-20 meters should be considered to have specifically disclosed subranges such as 1 meter, 2 meters, 1-2 meters, less than 2 meters, 10-11 meters, 10-12 meters, 10-13 meters, 10-14 meters, 11-12 meters, 11-13 meters, etc.

Furthermore, connections between components or systems within the figures are not intended to be limited to direct connections. Rather, data or signals between these components may be modified, re-formatted, or otherwise changed by intermediary components. Also, additional or fewer connections may be used. The terms "coupled," "connected," or "communicatively coupled" shall be understood to include direct connections, indirect connections through one or more intermediary devices, wireless connections, and so forth.

Reference in the specification to "one embodiment," "preferred embodiment," "an embodiment," "some embodiments," or "embodiments" means that a particular feature, structure, characteristic, or function described in connection with the embodiment is included in at least one embodiment of the invention and may be in more than one embodiment. Also, the appearance of the above-noted phrases in various places in the specification is not necessarily referring to the same embodiment or embodiments.

The use of certain terms in various places in the specification is for illustration purposes only and should not be construed as limiting. A service, function, or resource is not limited to a single service, function, or resource; usage of these terms may refer to a grouping of related services, functions, or resources, which may be distributed or aggregated.

Furthermore, one skilled in the art shall recognize that: (1) certain steps may optionally be performed; (2) steps may not be limited to the specific order set forth herein; (3) certain steps may be performed in different orders; and (4) certain steps may be performed simultaneously or concurrently.

The term "approximately", the phrase "approximately equal to", and other similar phrases, as used in the specification and the claims (e.g., "X has a value of approximately Y" or "X is approximately equal to Y"), should be understood to mean that one value (X) is within a predetermined range of another value (Y). The predetermined range may be plus or minus 20%, 10%, 5%, 3%, 1%, 0.1%, or less than 0.1%, unless otherwise indicated.

The indefinite articles "a" and "an," as used in the specification and in the claims, unless clearly indicated to the contrary, should be understood to mean "at least one." The phrase "and/or," as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements).

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements).

The use of "including," "comprising," "having," "containing," "involving," and variations thereof, is meant to encompass the items listed thereafter and additional items.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous. Other steps or stages may be provided, or steps or stages may be eliminated, from the described processes. Accordingly, other implementations are within the scope of the following claims.

It will be appreciated by those skilled in the art that the preceding examples and embodiments are exemplary and not limiting to the scope of the present disclosure. It is intended that all permutations, enhancements, equivalents, combinations, and improvements thereto that are apparent to those skilled in the art upon a reading of the specification and a study of the drawings are included within the true spirit and scope of the present disclosure. It shall also be noted that elements of any claims may be arranged differently including having multiple dependencies, configurations, and combinations.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A laundry sorting and processing system, comprising:

a plurality of soiled laundry containers and a plurality of clean laundry containers carried by a main frame, the plurality of soiled laundry containers each having a respective plurality of container flanges;

a plurality of laundry bags nestable in the plurality of soiled laundry containers, respectively, wherein each of the plurality of laundry bags is meshed and is sized and configured to receive a load of soiled laundry; and wherein the plurality of laundry bags each have a portion configured to extend over a respective plurality of the container flanges and to elastically compress against the respective plurality of container flanges so as to nest the plurality of laundry bags in the plurality of soiled laundry containers and prevent the plurality of laundry bags from sliding to where the plurality of laundry bags collapse.

2. The laundry sorting and processing system of claim 1, wherein each of the plurality of laundry bags is configured as flexible, malleable, and conformable to the plurality of soiled laundry containers, and wherein each of the plurality of laundry bags comprises:

a laundry bag bottom; laundry bag sidewalls extending from the laundry bag bottom; and a laundry bag interior formed by the laundry bag sidewalls and the laundry bag bottom.

3. The laundry sorting and processing system of claim 1, wherein the main frame comprises:

a plurality of posts; and at least one container frame supported by the plurality of posts, wherein the plurality of soiled laundry containers and the plurality of clean laundry containers are supported by the at least one container frame.

4. The laundry sorting and processing system of claim 3, wherein each container frame comprises:

a pair of elongated, parallel longitudinal frame members; and a pair of elongated, parallel transverse frame members extending between the longitudinal frame members.

5. The laundry sorting and processing system of claim 4, wherein a plurality of frame collars connect the transverse frame members to the longitudinal frame members of each container frame, and wherein the plurality of posts of the main frame extend through the plurality of frame collars.

6. The laundry sorting and processing system of claim 5, wherein the at least one container frame, the plurality of soiled laundry containers, and the plurality of clean laundry containers are arranged in one or more vertically spaced-apart laundry container rows on the main frame.

7. The laundry sorting and processing system of claim 6, wherein the one or more laundry container rows comprises two or more laundry container rows.

8. The laundry sorting and processing system of claim 3, wherein spaced-apart container rails are provided on each container frame, and wherein each of the plurality of clean laundry containers is configured to slidably engage the container rails.

9. The laundry sorting and processing system of claim 8, wherein each soiled laundry container of the plurality of soiled laundry containers comprises:

a container bottom;

a plurality of container sidewalls, wherein at least one of the plurality of container sidewalls comprises an air vent;

a container interior formed by the container bottom and the container sidewalls; and a container flange of the respective plurality of the container flanges extending from each of the plurality of container sidewalls.

10. The laundry sorting and processing system of claim 8, wherein each of the container rails comprises a pair of connectors configured to engage the respective longitudinal frame members of each container frame.

11. The laundry sorting and processing system of claim 1, wherein the plurality of soiled laundry containers and the plurality of clean laundry containers are various sizes.

12. The laundry sorting and processing system of claim 1, wherein the plurality of soiled laundry containers and the plurality of clean laundry containers are arranged in multiple columns on the main frame.

13. The laundry sorting and processing system of claim 1, wherein the main frame is configured as an item of furniture, and wherein the plurality of soiled laundry containers and the plurality of clean laundry containers are carried by the item of furniture.

14. The laundry sorting and processing system of claim 13, wherein the item of furniture comprises:

a pair of spaced-apart sidewalls, a bottom wall extending between the sidewalls; and a top wall extending between the sidewalls, wherein the plurality of soiled laundry containers and the plurality of clean laundry containers are insertable between the sidewalls and between the bottom wall and the top wall.

15. The laundry sorting and processing system of claim 14, at least one of the sidewalls comprises an air vent.

16. The laundry sorting and processing system of claim 1, wherein each soiled laundry container of the plurality of soiled laundry containers comprises:

a container bottom;

a plurality of container sidewalls, wherein at least one of the plurality of container sidewalls comprises an air vent;

a container interior formed by the container bottom and the container sidewalls; and wherein the plurality of container flanges includes a pair of the container flanges included in at least an opposite pair of container sidewalls of the plurality of container sidewalls, wherein each container flange of the pair of container flanges extends along an opposite longitudinal direction of a respective container sidewall of the opposite pair of container sidewalls.

17. The laundry sorting and processing system of claim 1, wherein each of the soiled laundry containers has a respective peripheral edge defining the respective container flanges, the plurality of laundry bags each having a respective sidewall edge defining the respective portion that is folded over a respective one of the peripheral edges of the soiled laundry containers.

18. The laundry sorting and processing system of claim 1, further comprising:

a coded indicator arranged in a manner that either distinguishes soiled laundry containers and the clean laundry containers from one from another, identifies the laundry bags that contain the soiled laundry in correlation with a user or owner of the soiled laundry, or identifies the laundry bags into which specific types of the laundry are placed.

19. The laundry sorting and processing system of claim 18, wherein the coded indicator is a color coding of the plurality of laundry bags.

20. A laundry sorting and processing system, comprising:

a plurality of soiled laundry containers and a plurality of clean laundry containers carried by a main frame, the plurality of soiled laundry containers each having a respective plurality of container flanges;

a plurality of laundry bags nestable in the plurality of soiled laundry containers, respectively, wherein each of the plurality of laundry bags is sized and configured to receive a load of soiled laundry; and wherein the plurality of laundry bags each have a portion configured to extend over a respective plurality of the container flanges and to elastically compress against the respective plurality of container flanges so as to nest the plurality of laundry bags in the plurality of soiled laundry containers and prevent the plurality of laundry bags from sliding to where the plurality of laundry bags collapse;

wherein the main frame comprises:

a plurality of posts; and at least one container frame supported by the plurality of posts, wherein the plurality of soiled laundry containers and the plurality of clean laundry containers are supported by the at least one container frame;

wherein each container frame comprises a pair of elongated, parallel longitudinal frame members; and a pair of elongated, parallel transverse frame members extending between the longitudinal frame members;

wherein a plurality of frame collars connect the transverse frame members to the longitudinal frame members of each container frame;

wherein the plurality of posts of the main frame extend through the plurality of frame collars;

wherein the at least one container frame, the plurality of soiled laundry containers, and the plurality of clean laundry containers are arranged in one or more vertically spaced-apart laundry container rows on the main frame; and wherein each container frame comprises a frame panel supported by the longitudinal frame members and the transverse frame members, wherein the frame panel separates the plurality of clean laundry containers from the plurality of soiled laundry containers in each laundry container row of the one or more laundry container rows.

21. The laundry sorting and processing system of claim 2, wherein each frame panel comprises a plurality of elongated, parallel, spaced-apart frame panel members extending between the longitudinal frame members of the respective container frame.

22. A laundry sorting and processing system, comprising:

a plurality of soiled laundry containers and a plurality of clean laundry containers carried by a main frame, the plurality of soiled laundry containers each having a respective plurality of container flanges;

a plurality of laundry bags nestable in the plurality of soiled laundry containers, respectively, wherein each of the plurality of laundry bags is sized and configured to receive a load of soiled laundry; and wherein the plurality of laundry bags each have a portion configured to extend over a respective plurality of the container flanges and to elastically compress against the respective plurality of container flanges so as to nest the plurality of laundry bags in the plurality of soiled laundry containers and prevent the plurality of laundry bags from sliding to where the plurality of laundry bags collapse;

wherein the main frame comprises:

a plurality of posts; and at least one container frame supported by the plurality of posts, wherein the plurality of soiled laundry containers and the plurality of clean laundry containers are supported by the at least one container frame;

wherein spaced-apart container rails are provided on each container frame, and wherein each of the plurality of clean laundry containers is configured to slidably engage the container rails;

wherein the container rails comprise a first pair of side container rails and a middle container rail or a second pair of side container rails positioned between the first pair of side container rails.

23. A laundry sorting and processing method, comprising the steps of:

carrying a plurality of soiled laundry containers and a plurality of clean laundry containers by a main frame, the plurality of soiled laundry containers each being meshed and having a respective plurality of container flanges;

nesting a plurality of laundry bags in the plurality of soiled laundry containers, respectively;

sizing and configuring each of the plurality of laundry bags to receive a load of soiled laundry, and extending a respective portion of the plurality of laundry bags each over a respective plurality of the container flanges to elastically compress against the respective plurality of container flanges so as to nest the plurality of laundry bags in the plurality of soiled laundry containers and prevent the plurality of laundry bags from sliding to where the plurality of laundry bags collapse into respective ones of the soiled laundry containers.

24. The method of claim 23, further comprising the step of folding respective ones of sidewall edges defining the respective portion of the plurality of laundry bags over respective peripheral edges defining the respective container flanges of the soiled laundry containers.

25. The method of claim 23, further comprising:

providing the plurality of laundry bags each with a coded indicator arranged in a manner that either distinguishes soiled laundry containers and the clean laundry containers from one from another, identifies the laundry bags that contain the soiled laundry in correlation with a user or owner of the soiled laundry, or identifies the laundry bags into which specific types of the laundry are placed.

26. The method of claim 25, wherein the coded indicator is a color coding of the plurality of laundry bags.

27. A laundry sorting and processing method, comprising the steps of:

carrying a plurality of soiled laundry containers and a plurality of clean laundry containers by a main frame, the plurality of soiled laundry containers each having a respective plurality of container flanges;

nesting a plurality of laundry bags in the plurality of soiled laundry containers, respectively;

sizing and configuring each of the plurality of laundry bags to receive a load of soiled laundry, and extending a respective portion of the plurality of laundry bags each over a respective plurality of the container flanges to elastically compress against the respective plurality of container flanges so as to nest the plurality of laundry bags in the plurality of soiled laundry containers and prevent the plurality of laundry bags from sliding to where the plurality of laundry bags collapse into respective ones of the soiled laundry containers;

wherein the plurality of soiled laundry containers each have an associated protruding projection defining the respective container flange that extends outward and the plurality of laundry bags each have the respective portion that is folded over the associated protruding projection to define an opening of a respective one of the plurality of laundry bags, wherein the respective one of the plurality of laundry bags is filled with a load of soiled laundry that was inserted through the opening, the respective one of the plurality of laundry bags being sized to close the opening after removing the portion from being folded over the associated protruding projection by repositioning the portion to overlie the load of soiled laundry, wherein the plurality of soiled laundry containers and the plurality of clean laundry containers are grouped into pairs of clean and soiled laundry containers, wherein with respect to each of the pairs of clean and soiled laundry containers, separating the clean and soiled laundry containers by a frame.

28. A laundry sorting and processing system, comprising:

a plurality of soiled laundry containers and a plurality of clean laundry containers carried by a main frame, the plurality of soiled laundry containers each having a respective plurality of container flanges;

a plurality of laundry bags nestable in the plurality of soiled laundry containers, respectively, wherein each of the plurality of laundry bags is sized and configured to receive a load of soiled laundry;

wherein the plurality of laundry bags each have a portion configured to extend over a respective plurality of the container flanges and to elastically compress against the respective plurality of container flanges so as to nest the plurality of laundry bags in the plurality of soiled laundry containers and prevent the plurality of laundry bags from sliding to where the plurality laundry bags collapse; and wherein the plurality of soiled laundry containers each have an associated protruding projection that extends outward and the plurality of laundry bags each have a respective portion that is folded over the associated protruding projection defining the respective container flanges to define an opening of the respective one of the plurality of laundry bags, wherein the respective one of the plurality of laundry bags is filled with a load of soiled laundry that was inserted through the opening, the respective one of the plurality of laundry bags being sized to close the opening after removing the portion from being folded over the associated protruding projection by repositioning the portion to overlie the load of soiled laundry, wherein the plurality of soiled laundry containers and the plurality of clean laundry containers are grouped into pairs of clean and soiled laundry containers, wherein with respect to each of the pairs of clean and soiled laundry containers, separating the clean and soiled laundry containers with a supporting frame.

* * * * *